US007975955B2

(12) United States Patent
Takeuchi

(10) Patent No.: US 7,975,955 B2
(45) Date of Patent: Jul. 12, 2011

(54) CONTINUOUS SHEET PROCESSING APPARATUS AND METHOD OF SETTING A ROLL BODY IN THE CONTINUOUS SHEET PROCESSING APPARATUS

(76) Inventor: Kiyokazu Takeuchi, Chiba (JP)

( * ) Notice: Subject to any disclaimer, the term of this patent is extended or adjusted under 35 U.S.C. 154(b) by 705 days.

(21) Appl. No.: 12/005,003

(22) Filed: Dec. 20, 2007

(65) Prior Publication Data

US 2008/0179444 A1 Jul. 31, 2008

(30) Foreign Application Priority Data

Jan. 24, 2007 (JP) ..... 2007-014239

(51) Int. Cl.
*B65H 16/10* (2006.01)

(52) U.S. Cl. ..... 242/564.1; 347/104

(58) Field of Classification Search ..... None
See application file for complete search history.

(56) References Cited

U.S. PATENT DOCUMENTS 2,873,927 A * 2/1959 McDonald ..... 83/252
5,672,020 A 9/1997 Leonard et al. ..... 400/690.4
5,676,367 A * 10/1997 Oshino et al. ..... 271/212

FOREIGN PATENT DOCUMENTS

EP 0990533 4/2000
EP 1145861 10/2001

* cited by examiner

*Primary Examiner* — Manish S Shah
*Assistant Examiner* — Alexander C Witkowski
(74) *Attorney, Agent, or Firm* — Adams & Wilks

(57) ABSTRACT

A continuous sheet processing apparatus has a frame, a roll body accommodating portion disposed inside of the frame for accommodating a roll body formed of a wound continuous sheet, and a cover mounted for undergoing pivotal movement between open and closed positions relative to the frame so as to allow the insertion of the wound continuous sheet into the roll body accommodating portion in the open position of the cover. A processing portion has a processing head and a platen roller confronting the processing head. The processing head performs a processing operation with respect to the continuous sheet drawn out from the roll body accommodating portion in a state in which the cover is in the closed position. The platen roller transports the continuous sheet in a state in which the cover is in the closed position.

20 Claims, 18 Drawing Sheets

CONTINUOUS SHEET PROCESSING APPARATUS AND METHOD OF SETTING A ROLL BODY IN THE CONTINUOUS SHEET PROCESSING APPARATUS

BACKGROUND OF THE INVENTION

1. Field of the Invention

The present invention relates to a continuous sheet processing apparatus for performing a processing such as printing or thermal activation with respect to a continuous sheet, and a method of setting a roll body in the continuous sheet processing apparatus.

2. Description of the Related Art

Hitherto, there is commonly known a continuous sheet processing apparatus, in which a continuous sheet is successively drawn but from a roll body to perform a processing such as printing or thermal activation with respect to the continuous sheet which is drawn out and a portion on which the processing is performed is cut off, thereby obtaining cut-form paper.

As a method of holding the roll body in the continuous sheet processing apparatus as described above, as disclosed in Patent Document 1, there is available a method in which a central shaft (roll shaft) is inserted into a central hole of a roll body and end portions of the central shaft, which laterally protrude from the roll body, are supported by a frame (first related art example). Further, as disclosed in Patent Document 2, there is available a method in which a fitting portion of each of bobbins (holders) provided to a frame is inserted into a central hole of a roll body from a side thereof, for supporting the roll body (second related art example). Further, as disclosed in Patent Documents 3 and 4, there is available a method in which a roll body is merely placed on a bottom surface of a roll body accommodating portion (third and fourth related art examples).

[Patent Document 1] JP 2003-146493 A

[Patent Document 2] JP 2000-211777 A

[Patent Document 3] JP 2003-251875 A

[Patent Document 4] JP 2001-293927 A

In the first related art example described above, there are required an operation of inserting the central shaft into the central hole of the roll body and an operation of attaching the central shaft holding the roll body to the frame, thereby being troublesome. Further, in order to prevent a situation where the central shaft detachable with respect to the frame is lost by mistake, thereby making supporting of the roll body thereafter impossible, a user must be cautious. In particular, in a case where the user misconceives that the central shaft is an accessory of the roll body, after processing of an entire continuous sheet drawn out from the roll body is completed, when the roll body is consumed, the central shaft is discarded. After that, when there is a need for a new roll body to be used, the central shaft is not available, so there may arise a problem in that holding of the roll body cannot be performed.

In the second related art example, the bobbin is provided to the frame so as not to be removable therefrom. Accordingly, unlike in the first related art example, there is no risk of losing the bobbin by mistake. Further, by only one operation of inserting the bobbin into the central hole of the roll body, the holding of the roll body is completed. Accordingly, the number of operations decreases compared to the first related art example requiring the two operations. However, the operation of inserting the bobbin into the central hole of the roll body in a confined space of the roll body accommodating portion is extremely complicated. Specifically, positioning of the fitting portion of the bobbin with respect to the central hole of the roll body by fumbling of the user, and moving the fitting portion of the bobbin with respect to the frame to insert the fitting portion into the central hole are extremely complicated. In particular, in a case where a clearance between the fitting portion of the bobbin and the central hole of the roll body is smaller, positioning and insertion operations become more complicated. Further, at a time of positioning or attaching, there is a risk of damaging a side portion of the roll body by a tip of the fitting portion of the bobbin, thereby leaving a flaw or deformation in an edge portion of the continuous sheet.

In the first and second related art examples, when the roll body is not set in a correct position by the central shaft or the bobbin, it is impossible to draw out the continuous sheet from the roll body to supply the continuous sheet to a processing portion.

In contrast, in the third and fourth related art examples, there is no need of an attachment operation of inserting the central shaft or the fitting portion of the bobbin into the central hole of the roll body, or the like, and there is only need of inserting the roll body into the roll body accommodating portion, so operability is remarkably favorable.

An example of the above-mentioned structure is shown in FIG. 19. In this structure, a processing portion 3 is provided above and on a lateral side of a roll body accommodating portion 2 (position shifted in horizontal direction from position directly above central axis of roll body 1*a* accommodated in roll body accommodating portion 2). A platen roller 5 of the processing portion 3 is rotated, thereby allowing the continuous sheet 1 of the roll body 1*a* to be successively drawn out to be supplied to the processing portion 3.

The roll body 1*a* is hardly restricted in a space of the roll body accommodating portion 2 and freely movable therein. Therefore, when the continuous sheet 1 drawn out from the roll body 1*a* is transported while being pulled by a platen roller 5 provided to the processing portion 3, there is such a risk that the roll body 1*a* randomly moves in the roll accommodating body 2 by the pulling force. In particular, in the structure as shown in FIG. 19, the processing portion 3 is positioned above the roll body accommodating portion 2. Accordingly, at a time of transporting the continuous sheet 1, there is a fear of the roll body 1*a* being lifted up. The roll body 1*a* does not stably become standstill in a state where the roll body 1*a* is lifted up, and performs irregular operations in the roll body accommodating portion 2. In particular, in a case where the continuous sheet 1 is intermittently transported, when transportation of the continuous sheet 1 is performed (when continuous sheet 1 is pulled up), the roll body 1*a* is lifted up, and when transportation of the continuous sheet 1 is not performed (when continuous sheet 1 is not pulled), the roll body 1*a* falls down on a bottom surface of the roll body accommodating portion 2 due to the gravity. In a case where the lifting up and the falling down of the roll body 1*a* are repeated as described above, large irregular movements of the roll body 1*a* are caused. As a result, the continuous sheet 1 cannot be correctly supplied to the processing portion 3. Therefore, there occurs operation failures, in which, for example, the continuous sheet 1 is transported while being oriented obliquely, a transport speed becomes nonuniform, and finally, the transportation is impossible. Further, there is a risk of causing abnormalities in processing by a processing head 4 of the processing portion 3, such as printing failure, and variation in or absence of thermal activation.

Further, in the roll body accommodating portion 2, there may be provided a sensor 18 for detecting a size of the roll body 1*a*, that is, a remaining amount of the sheet by performing detection on a part of the roll body 1*a*. In this case, when the roll body 1*a* performs the irregular operations such as the lifting up of the roll body 1*a* as described above in the roll body accommodating portion 2 and the roll body 1*a* temporarily gets out of a detection region of the sensor 18, there is a risk of making misjudgment that the remaining amount of the sheet is small regardless of the size of the roll body 1*a*.

SUMMARY OF THE INVENTION

It is therefore an object of the present invention to provide a continuous sheet processing apparatus in which, even with a structure in which setting of the roll body in the roll body accommodating portion is extremely easy, it is possible to stably transport the continuous sheet drawn out from the roll body without causing the irregular movements such as the lifting up of the roll body, and a method of setting a roll body in the continuous sheet processing apparatus.

The present invention provides a continuous sheet processing apparatus including a frame and a cover which can be opened and closed with respect to the frame, characterized by including: a roll body accommodating portion for accommodating a roll body formed of a wound continuous sheet; a processing portion, which is arranged in a position above the roll body accommodating portion and horizontally shifted from a position directly above a central axis of the roll body accommodated in the roll body accommodating portion, for performing a processing with respect to the continuous sheet drawn out from the roll body; and a guide member positioned between the roll body accommodating portion and the processing portion and capable of guiding the continuous sheet drawn out from the roll body, the continuous sheet processing apparatus being characterized in that: the guide member has an engagement portion capable of engaging with the continuous sheet drawn out from the roll body and is attached to an arm; the arm can move between an inside of the frame and an outside of the frame as an operation independent of an opening and closing operation of the cover or as a combined operation of the opening and closing operation of the cover and a relative movement with respect to the cover; and in a state where the arm is positioned in the inside of the frame, at least a part of the engagement portion of the guide member is arranged in a position above the roll body accommodated in the roll body accommodating portion and on an opposite side of the processing portion with respect to the central axis of the roll body.

With this structure, even in a case where, when accommodating the roll body in the roll body accommodating portion, there is no need of special positioning and attachment operations and setting can easily be achieved by only inserting the roll body into the roll body accommodating portion, when the continuous sheet drawn out from the roll body is transported by being pulled by the processing portion positioned above the roll body accommodating portion, the roll body does not involve a movement such as lifting up thereof. Further, the arm to which the guide member is mounted moves as the operation independent of the opening and closing operation of the cover or as the combined operation of the opening and closing operation of the cover and the relative movement with respect to the cover. As a result, it becomes possible to facilitate arrangement of the guide member to the position on the opposite side of the processing portion with respect to the central axis of the roll body before the cover is closed as described above. By moving the arm in this manner, in order to set the roll body, it is not necessary to perform the operation by fumbling in a confined space of the roll body accommodating portion, so operability is remarkably favorable.

The arm may be pivotally connected to the cover.

There may be further included a link arm which is pivotally connected to each of the arm and the cover and constitutes, together with the arm, a link mechanism. In this case, the link mechanism may have a structure in which a part of the link arm abuts on a cam provided to the frame, thereby allowing the link arm to relatively pivot with respect to the cover, and together with pivoting of the link arm, the arm connected to the link arm is allowed to relatively pivot with respect to the cover. With this structure, there is only a need for the user to perform the opening and closing operation of the cover and there is no need for the user to directly operate the guide member and the arm itself. Accordingly, the guide member and the arm itself can be moved in a substantially automatic manner, so it is possible to extremely easily realize the arrangement of the guide member as described above.

A structure, in which, in the operation of closing the cover, the arm moves before the cover, and in the operation of opening the cover, the arm moves by following the cover, is preferable because an attachment and detachment operation of the roll body is facilitated.

Further, there may be employed a structure in which the arm is moved manually. With this structure, unlike with the above-mentioned structure, the guide member and the arm cannot be moved in the substantially automatic manner, but the structure can be simplified.

The processing portion includes a processing head for performing a processing with respect to the continuous sheet drawn out from the roll body and a platen roller, which is opposed to the processing head, for transporting the continuous sheet. The processing portion may include a printing portion for performing printing on the continuous sheet drawn out from the roll body. Alternatively, the processing portion may include a thermal activation portion for heating and thermally activating the continuous sheet drawn out from the roll body.

The present invention further provides a method of setting a roll body in a continuous sheet processing apparatus including: a frame; a cover which can be opened and closed with respect to the frame; a roll body accommodating portion for accommodating a roll body formed of a wound continuous sheet; and a processing portion, which is arranged in a position above the roll body accommodating portion and horizontally shifted from a position directly above a central axis of the roll body accommodated in the roll body accommodating portion, for performing a processing with respect to the continuous sheet drawn out from the roll body, the method of setting a roll body in a continuous sheet processing apparatus being characterized by including: inserting, when the cover is in an open state, the roll body into the roll body accommodating portion in a state where an end portion of the continuous sheet is pulled out from the roll body; entering, after an operation of closing the cover with respect to the frame is started, a guide member into a space between the roll body and the continuous sheet pulled out from the roll body by moving an arm to which the guide member is attached; and engaging, when the cover is closed with respect to the frame, at least a part of an engagement portion of the guide member with the continuous sheet by arranging the at least the part of the engagement portion in a position above the roll body and on an opposite side of the processing portion with respect to the central axis of the roll body.

By this method, as described above, it is possible to easily realize a state where, when the continuous sheet drawn out from the roll body is transported by being pulled by the processing portion Positioned above the roll body accommodating portion, a movement such as the lifting up of the roll body is not involved.

It is preferable that a movement of the arm be performed as an operation independent of the operation of closing the cover or as a combined operation of an opening and closing operation of the cover and a relative movement with respect to the cover.

Further, in a case where a link arm which is pivotally connected to each of the arm and the cover and constitutes, together with the arm, a link mechanism is used, after the operation of closing the cover with respect to the frame is started, by allowing a part of the link arm to abut on a cam provided to the frame, the link arm may be allowed to relatively pivot with respect to the cover to relatively pivot the arm connected to the link arm with respect to the cover together with pivoting of the link arm. With this structure, there is only a need for the user to perform the opening and closing operation of the cover and there is no need for the user to directly operate the guide member and the arm itself. Accordingly, the guide member and the arm itself can be moved in the substantially automatic manner, so it is possible to extremely easily realize the arrangement of the guide member as described above.

It is preferable that, the arm be moved before the cover in the operation of closing the cover and be moved by following the cover in the operation of opening the cover.

According to the present invention, even in the structure in which the roll body can easily be set only by being put into the roll body accommodating portion, there is not involved the movement such as the lifting up of the roll body at the time of transporting the continuous sheet drawn out from the roll body, thereby enabling favorable transportation thereof. Further, in the operation of closing the cover, the guide member can be arranged in a position on the opposite side of the processing portion with respect to the central axis of the roll body, where the engagement portion engages with the continuous sheet pulled out from the roll body, thereby making it possible to easily realize a structure with which the above-mentioned effect is obtained. In particular, there is no need of performing the operation by fumbling in a confined space of the roll body accommodating portion for setting the roll body, thereby making an operability extremely favorable.

DETAILED DESCRIPTION OF THE PREFERRED EMBODIMENT

Hereinafter, a description will be made of embodiments of the present invention with reference to the drawings.

(Structure of Continuous Sheet Processing Apparatus)

Figure 1:
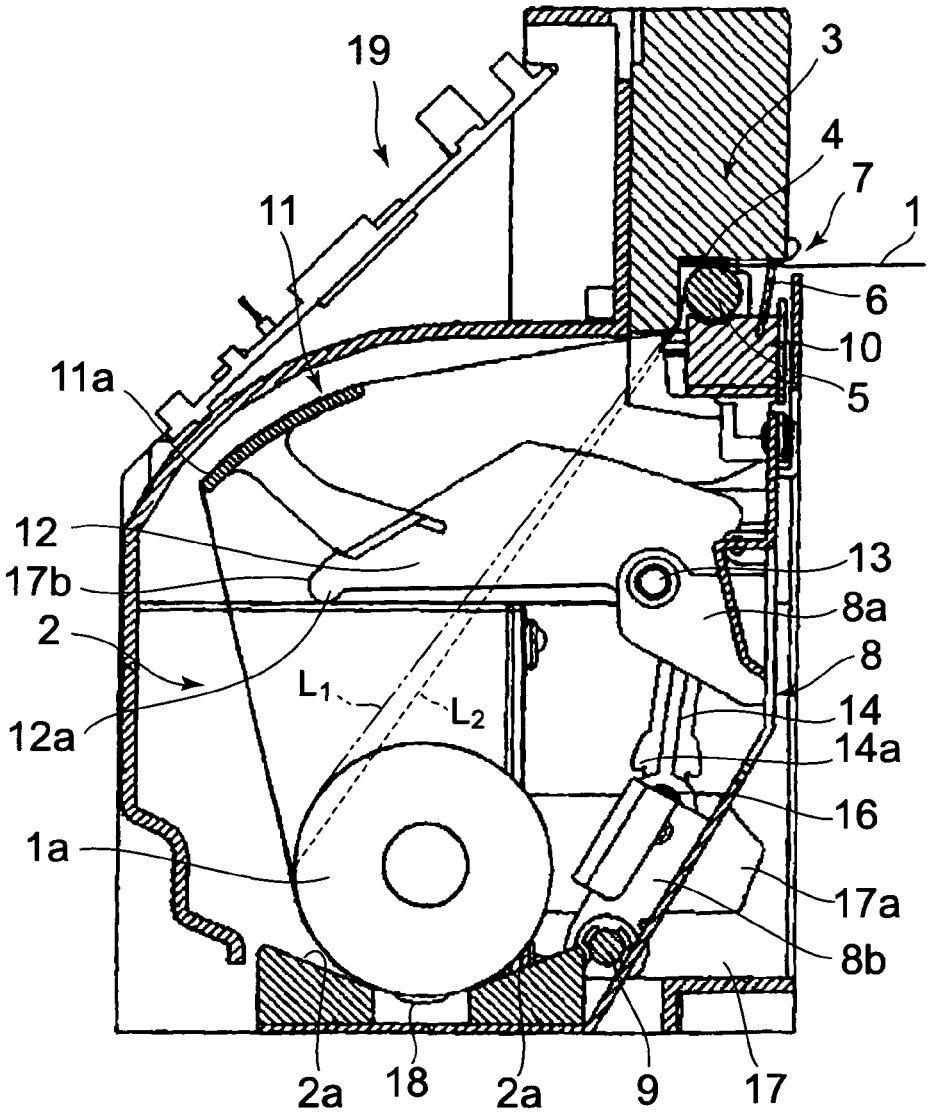
FIG. 1 is a sectional view of a continuous sheet processing apparatus according to a first embodiment of the present invention.
Figure 2:
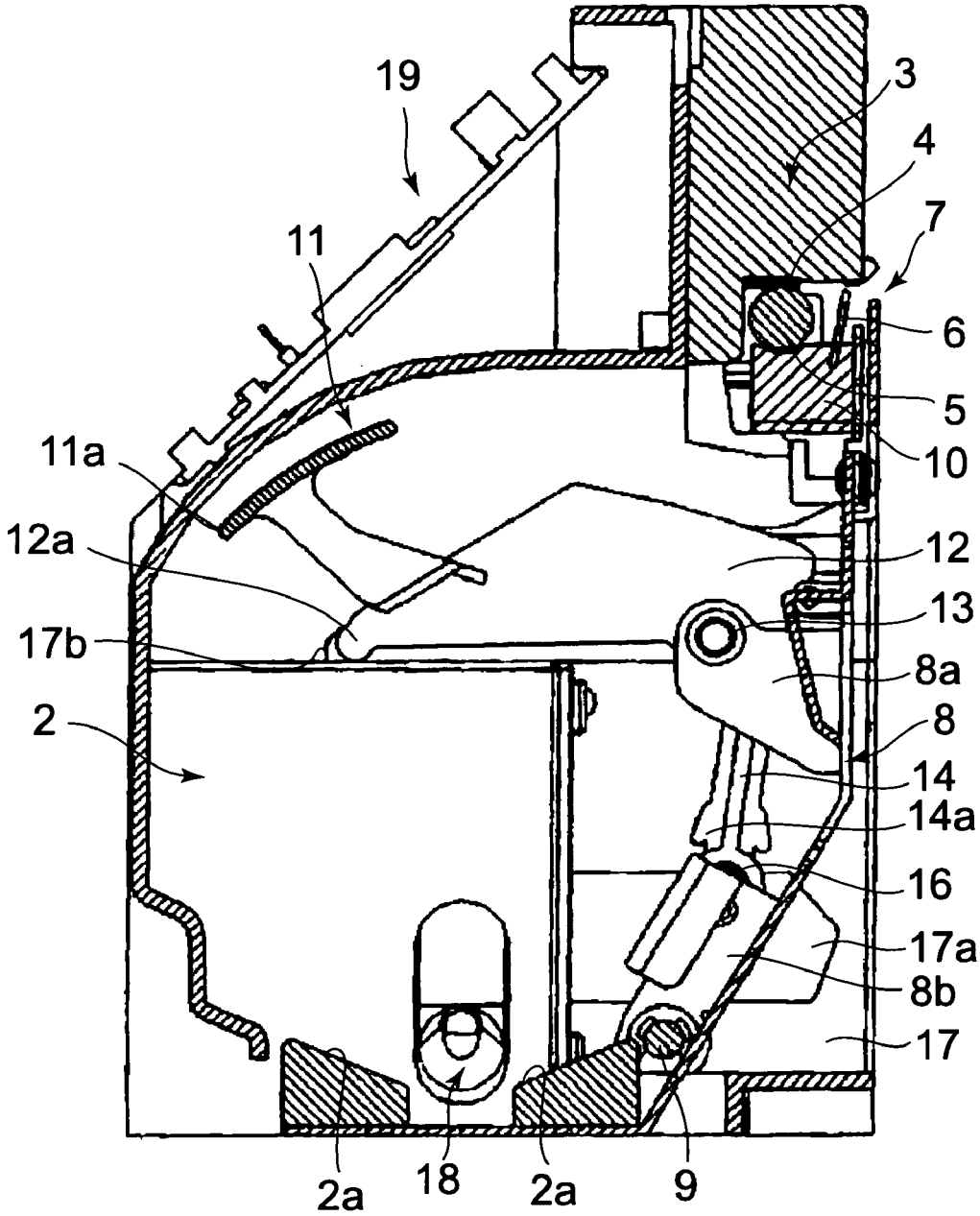
FIG. 2 is a sectional view of the continuous sheet processing apparatus shown in FIG. 1 in a state where a roll body is not set therein.

FIGS. 1 and 2 each show an inner structure of a continuous sheet processing apparatus of the present invention. FIG. 1 shows a state where a roll body 1*a* in which a continuous sheet 1 is wound is accommodated therein. FIG. 2 shows a state where the roll body 1*a* is not accommodated therein. The continuous sheet processing apparatus includes a roll body accommodating portion 2 for accommodating the roll body 1*a* and a processing portion 3 provided in a position above and on a lateral side of the roll body accommodating portion 2 (right side in FIGS. 1 and 2, that is, position shifted in horizontal direction from position P3 (see FIG. 3B) directly above central axis of roll body 1*a* accommodated in roll body accommodating portion 2).

The roll body accommodating portion 2 has a pair of inclination surfaces 2*a* forming a substantially V shape section, for supporting an outermost peripheral surface of the roll body 1*a*. Both the pair of inclination surfaces 2*a* come into line contact (point contact when viewed in sectional view as shown in FIG. 1) with the outermost peripheral surface of the roll body 1*a*, thereby supporting the roll body 1*a*. With this structure, a center of the roll body 1*a* accommodated in the roll body accommodating portion 2 and a center of the roll body accommodating portion 2 are positioned on the same straight line. That is, positions of the center of the roll body accommodating portion 2 and the center of the roll body 1*a* substantially coincide with each other at least in a width direction (left-and-right direction in FIGS. 1 and 2) of the apparatus. In the roll body accommodating portion 2, there is provided a sensor 18 for detecting a remaining amount of the roll body 1*a*.

The processing portion 3 includes a processing head 4 and a platen roller 5 positioned so as to be opposed to the processing head 4. The processing head 4 and the platen roller 5 sandwich therebetween the continuous sheet 1 processed in the present invention. The platen roller 5 supports the continuous sheet 1 while pressing the continuous sheet 1 to the processing head 4 and is driven by driving means (not shown) to be rotated to successively transport the continuous sheet 1. The processing head 4 performs the processing with respect to the continuous sheet 1 supported by the platen roller 5. Examples thereof include a recording head for performing recording on a continuous sheet having a recordable surface, and a thermal activation head for generating adhesiveness by heating a continuous sheet having a heat-sensitive adhesion surface. On a downstream side of the processing head 4 and the platen roller 5, a cutter portion is provided. Further, on a downstream side of the cutter portion, an outlet 7 to an outside is provided. The cutter portion of this embodiment includes a movable blade and a stationary blade 6 opposed to the movable blade (not shown). The movable blade moves toward the stationary blade 6, thereby making it possible to cut the continuous sheet 1. In each of FIGS. 1 and 2, the movable blade is positioned in a retracted position, so the movable blade is not shown.

In the continuous sheet processing apparatus, there is provided a cover 8. The cover 8 pivots about a shaft 9, thereby being capable of opening and closing with respect to a frame 17. The platen roller 5 and the stationary blade 6 of the cutter portion are mounted to the cover 8 through support members 10 and move integrally with the cover 8.

To the cover 8, a guide plate (guide member) 11 is mounted through arms 12. Each of the arms 12 is mounted to each of first projection portions 8*a*, which are provided to the cover 8, so as to be pivotal about a shaft 13. Further, between each of the arms 12 and each of second projection portions 8*b* provided to the cover 8, a link arm 14 is mounted. Each of the link arms 14 is pivotal about a shaft 15 (see FIG. 4B) with respect to each of the arms 12, and is also pivotal about a shaft 16 with respect to the cover 8. By the arms 12 and the link arms 14, the guide plate 11 can be moved within a certain movement range independently of the cover 8. Further, although not shown, between each of the arms 12 and a part of the cover 8, a spring (not shown) is provided. Note that, as shown in a perspective view of FIG. 4A or the like, the arm 12, the link arm 14, and the projection portions 8*a* and 8*b* are provided to each side portion of the cover 8. The guide plate 11 is mounted so as to extend between the first link arms 12 positioned on the both side portions.

Each of the link arms 14 is provided with a protruding portion 14*a*. An inner surface of the frame 17 is provided with cams 17*a*. Further, each of the arms 12 is provided with a protruding portion 12*a*. The inner surface of the frame 17 is also provided with guide grooves 17*b*. Therefore, in a later-described operation of closing the cover 8, when the protruding portions 14*a* come into contact with the cams 17*a*, the link arms 14 are pushed, and against a spring force of the springs (not shown), the link arms 14, the arms 12, and the guide plate 11 are moved as an operation independent of a movement of the cover 8 or as a combined operation of an opening and closing operation of the cover 8 and a relative movement with respect to the cover 8. Further, the movement is regularly performed by allowing the protruding portions 12*a* of the arms 12 to slide into the guide grooves 17*b*.

As shown in FIGS. 1 and 2, when the cover 8 is in a closed state, a position of an end portion of the guide plate 11 is biased to an opposite side of the processing portion 3 (left side in FIGS. 1 and 2). At least the end portion operates as an engagement portion 11*a* engaging with the continuous sheet 1.

Here, when a consideration is made of a transport path for the continuous sheet, if the guide plate 11 does not exist, the transport path for the continuous sheet is formed along a straight line L1 connecting between a drawing out portion of the roll body 1*a* and the processing portion 3. In contrast to this, in the structure of this embodiment, as shown in FIG. 1, the engagement portion 11*a* of the guide plate 11 forms the transport path which guides the continuous sheet 1 to the opposite side of the processing portion 3 (left side in FIGS. 1 and 2) once with respect to the straight line L1 and guides the continuous sheet 1 to the processing portion 3 thereafter. In a strict sense, in a case where the guide plate 11 exists, a position of the drawing out portion of the roll body 1*a* slightly moves, and a straight line L2 connecting the drawing out portion of the roll body 1*a* in this case and the processing portion 3 is slightly different from the straight line L1. The engagement portion 11*a* is arranged so as to guide the continuous sheet 1 to the opposite side of the processing portion 3 (left side in FIGS. 1 and 2) once with respect to both the straight line L1 and the straight line L2.

In this embodiment, a bottom surface portion, on which the inclination surfaces 2*a* for supporting the roll body 1*a* are provided, is also connected to the cover 8. On an outer portion of the frame 17, although not described in detail, a panel 19 provided with a display portion, an input portion, and the like is arranged.

(Outline of Processing Method for Continuous Sheet)

A description will be made of an outline about a processing operation by the continuous sheet processing apparatus. First, the roll body 1*a* is set in the continuous sheet processing apparatus. The setting operation may be performed by only inserting the roll body 1*a* into a space of the roll body accommodating portion 2. At this time, in a state where an end of the continuous sheet 1 is pulled out from the roll body 1*a* and is sandwiched between the processing head 4 of the processing portion 3 and the platen roller 5, the cover 8 is closed. At this time, the continuous sheet 1 pulled out from the roll body 1*a* is guided to the opposite side of the processing portion 3 (left side in FIGS. 1 and 2) once by the engagement portion 11*a* of the guide plate 11 as described above, and is guided to the processing portion 3 positioned on a right side in FIGS. 1 and 2.

In this state, a drive signal is sent from control means (not shown) to the processing head 4. As a result, the processing head 4 performs a processing with respect to the continuous sheet 1 and the driving means (not shown) allows the platen roller 5 to be rotated, thereby transporting the continuous sheet 1. An operation of the processing head 4 and an operation of the platen roller 5 are synchronized with each other, thereby successively performing a processing with respect to the continuous sheet 1. Note that the processing head 4 may be a thermal head or the like. Printing on the continuous sheet 1 or thermal activation by heating the heat-sensitive adhesive layer provided to the continuous sheet 1 is performed. When the processing of the continuous sheet 1 of a predetermined length is completed, the transportation of the continuous sheet 1 is stopped and the movable blade (not shown) of the cutter portion is moved toward the stationary portion 6, thereby cutting off the continuous sheet 1 which has undergone the processing. In a case of successively performing the processing of the continuous sheet 1, the transportation of the continuous sheet 1 by the platen roller 5 and the processing by the processing head 4 are performed again, the transportation of the continuous sheet 1 is stopped, and the continuous sheet 1 is cut off.

As described above, also in a case of intermittently transporting the continuous sheet 1 through the rotation of the platen roller 5, according to this embodiment, the roll body hardly moves and only rotates, so the stable transportation of the continuous sheet 1 is possible.

(Consideration of Transportation State of Continuous Sheet)

As described above, consideration will be made below of a reason why the stable transportation of the continuous sheet 1 is enabled by this embodiment.

Figure 3A:
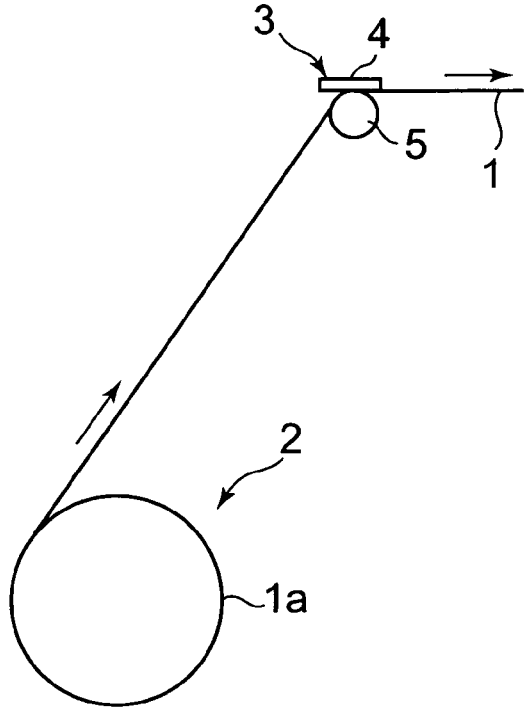
FIG. 3A PRIOR ART
FIG. 3A is a schematic diagram showing a continuous sheet transport path of a related art continuous sheet processing apparatus.

In the related art structure in which the guide plate 11 does not exist, the reason for performing the irregular movement such as the lifting up of the roll body 1*a* together with the transportation of the continuous sheet 1 is conceived that, as schematically shown in FIG. 3A, the platen roller 5 of the processing portion 3 positioned above the roll body accommodating portion 2 rotates and a force attempting to transport the continuous sheet 1 acts mainly in a direction in which the roll body 1*a* is lifted up against the gravity, that is, a component of the force in a vertically upward direction is large. In the case where the roll body 1*a* is lifted up, when, for example, the continuous sheet is cut off, the rotation of the platen roller 5 is stopped to temporarily stop the transportation of the continuous sheet 1, and a force for lifting up the roll body 1*a* is thus eliminated, thereby causing the roll body 1*a* to fall down due to the gravity. The lifting up and the falling down of the roll body 1*a* are repeated, so a position of the roll body 1*a* does not become stable, and due to an impact or a reaction in the lifting up and the falling down of the roll body 1*a*, the roll body 1*a* is oriented obliquely with respect to a longitudinal direction thereof, whereby the roll body 1*a* is not held in a stable manner. As a result, a favorable transportation state of the continuous sheet cannot be continued, thereby causing processing failures (such as printing failure and variation in thermal activation). Further, when the roll body 1*a* is temporarily lifted up, the roll body 1*a* gets out of the detection range of the sensor 18, and there is a risk of making misjudgment that the remaining amount of the continuous sheet 1 is small even though the remaining amount of the continuous sheet 1 is sufficient.

Figure 3B:
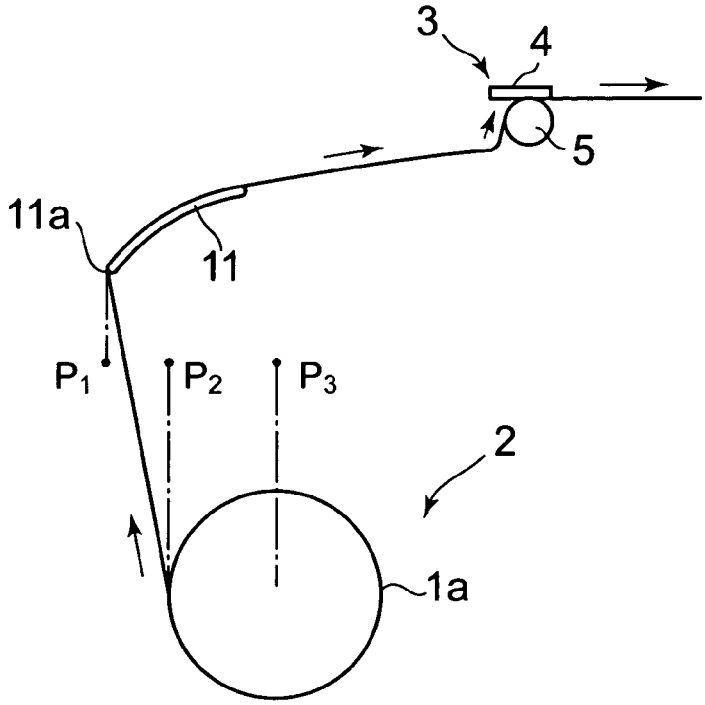
FIG. 3B is a schematic diagram showing a continuous sheet transport path of the continuous sheet processing apparatus shown in FIG.

In contrast to this, in this embodiment, as schematically Shown in FIG. 3B, the force generated by the rotation of the platen roller 5 of the processing portion 3 positioned above the roll body accommodating portion 2, which attempts to transport the continuous sheet 1, acts as a force for pulling the continuous sheet 1 in the substantially horizontal direction from a portion engaged with the engagement portion 11*a* of the guide plate 11 but hardly acts in the direction of lifting up the roll body 1*a* against the gravity (vertically upward direction). Therefore, the roll body 1*a* is not lifted up by the force for transporting the continuous sheet 1. Note that it is probable that, while the transport path between the engagement portion 11*a* and the drawing out portion of the roll body 1*a* forms an obtuse angle close to the vertically upward direction, the position where the continuous sheet 1 is engaged with the engagement portion 11*a* of the guide plate 11 functions as a buffer for the transmission force, which is generated by the rotation of the platen roller 5 to the roll body 1*a*, in a midway of the transmission of the transportation force. Therefore, a force which is abrupt and strong enough to lift up the roll body 1*a* against the gravity is not transmitted to the roll body 1*a*.

Further, in this embodiment, the position of the portion of the continuous sheet 1 engaged with the engagement portion 11*a* of the guide plate 11 is biased to the opposite side (left side in FIGS. 1 to 3A-3B) of the processing portion 3. Accordingly, the continuous sheet 1 always receives a tensile force in the horizontal direction in the engagement portion thereof, thereby being tensioned. Therefore, there is no play allowing the roll body 1*a* to bounce up and down. For those reasons, in this embodiment, it is probable that the roll body 1*a* is hardly lifted up together with the transportation of the continuous sheet 1. The roll body 1*a* is not lifted up, so as a matter of course, the roll body 1*a* does not fall down due to the gravity when the transportation of the continuous sheet 1 is stopped. It is possible to prevent the sensor 18 from making the misjudgment. Note that, in this embodiment, the roll body 1*a* is held in the portion having the substantially V shape formed by the pair of inclination surfaces 2*a*, so the roll body 1*a* hardly moves in the horizontal direction (left-and-right direction in FIGS. 1 to 3A-3B).

Further, in this embodiment, the path is formed in the processing portion 3 such that the continuous sheet 1 is once moved upwardly by a slight distance, and after that, the continuous sheet 1 is allowed to reach a position between the processing portion 3 and the platen roller 5 to be transported in the horizontal direction. A portion for allowing the continuous sheet 1 to be transported upwardly by the slight distance also has a buffering function regarding the transmission of the transportation force. As described above, it is probable that the more direction conversion portions are provided in the transmission path for the force (path corresponding to transport path of continuous sheet 1), which extends from the portion generating the transportation force (platen roller 5) to the portion which may be moved (roll body 1*a*), the larger effects of absorbing and buffering the impact become, thereby suppressing the abrupt and irregular movement of the roll body 1*a*. For that implication, in this embodiment, there are provided more direction conversion portions than in a related art invention. Accordingly, it is possible to prevent undesirable movements such as the lifting up of the roll body.

In order to obtain the effect of the present invention as described above, when viewed in the horizontal direction (left-and-right direction in FIG. 3B), a position P1 of the engagement portion 11*a* of the guide plate 11 must be arranged at least on the opposite side (left side in the figure) of the side (right side in the figure) on which the processing portion 3 is positioned with respect to the position P3 directly above the central axis of the roll body 1*a*. The engagement portion 11*a* is preferably arranged while being biased to the opposite side (left side in the figure) of the side (right side in the figure) on which the processing portion 3 is positioned with respect to a position P2 at an outermost end of the roll body 1*a*. By keeping the positional relationships as described above, there is structured the transport path such that the continuous sheet 1 is once guided to the opposite side (left side in the figure) of the processing portion 3 by the engagement portion 11*a* of the guide plate 11 with respect to the path in the case of straightly transporting the continuous sheet from the roll body 1*a* to the processing portion 3 (see FIG. 3A), and after that, the direction of the continuous sheet 1 is changed again to be lead to the processing portion 3. As a result, the roll body 1*a* is not lifted up or falls down as described above and is held in the stable manner, thereby enabling the favorable transportation.

(Opening and Closing Operation of Cover)

Next, the opening and closing operation of the cover 8 according to this embodiment will be described with reference to FIG. 4A-4C to 11A-11C. Here, the description will be made of an operation of closing the cover 8 in a state where the cover 8 is in the open state. This is a method of setting the roll body lain the continuous sheet processing apparatus. Note that, in each of FIGS. 4A-4C and 6A-6C to 11A-11C, FIGS. 4A, 6A, 7A, 8A, 9A, 10A and 11A are a perspective view in which illustration of the roll body 1*a* is omitted, FIGS. 4B, 6B, 7B, 8B, 9B, 10B and 11B are a sectional view in which illustration of the roll body 1*a* is omitted, and FIGS. 4C, 6C, 7C, 8C, 9C, 10C and 11C are a sectional view including the roll body 1*a*.

Figure 4A:
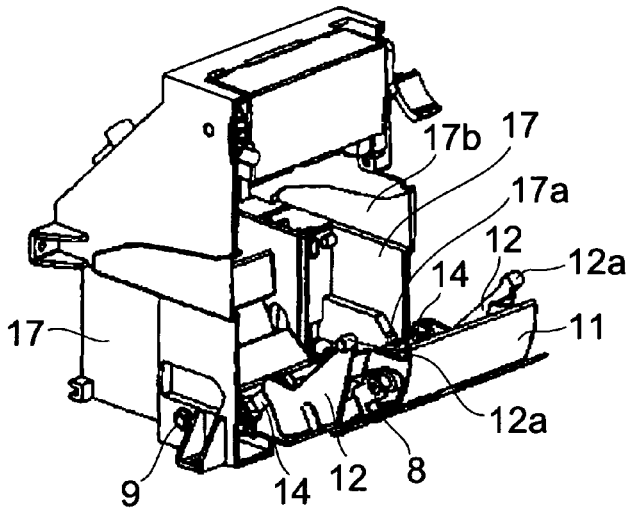
FIG. 4A is a perspective view showing a state where a cover of the continuous sheet processing apparatus shown in FIG. 1 is in an open state with the roll body being omitted.
Figure 4B:
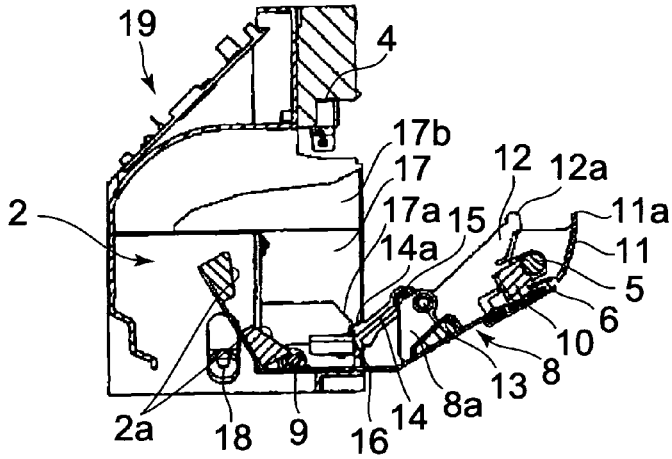
FIG. 4B is a sectional view with the roll body being omitted.
Figure 4C:
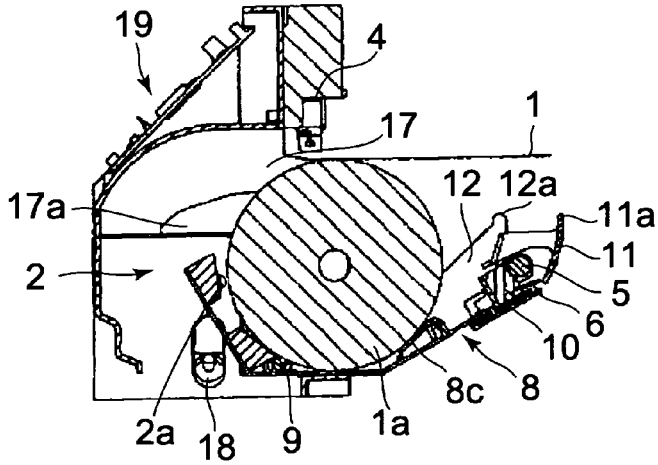
FIG. 4C is a sectional view including the roll body.

FIG. 4A-4C each show a state where the cover 8 is completely opened. In this state, by the spring force of the springs (not shown), the arms 12 are in the open state together with the cover 8. In this state, the roll body 1*a* is inserted into the cover 8. In this state, the roll body 1*a* is held in a relatively stable manner by one (right one in the figures) of the inclination surfaces 2*a* on the bottom surface portion connected to the cover 8 and an inclination surface 8*c* provided to the cover 8 (see, FIG. 4C).

Figure 5A:
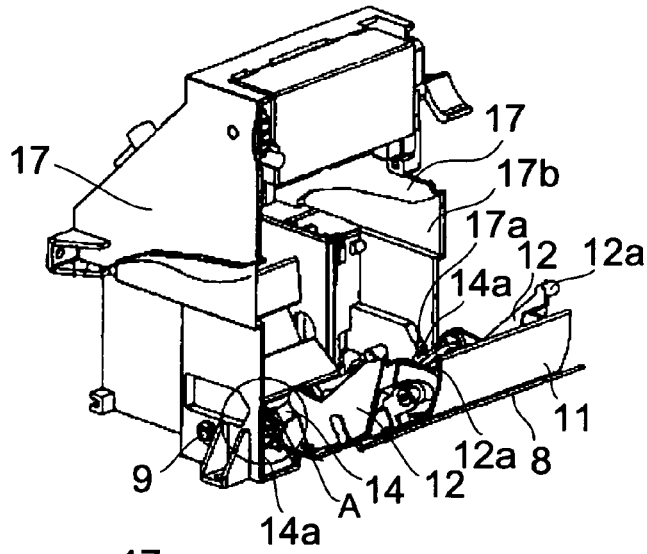
FIG. 5A is a perspective view showing a state where the cover of the continuous sheet processing apparatus shown in FIG. 1 starts to be closed with the roll body being omitted.
Figure 5B:
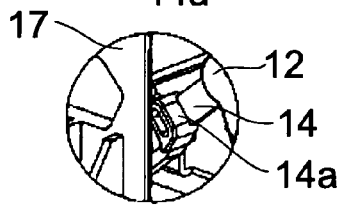
FIG. 5B is an enlarged view of a portion A of FIG. 5A.
Figure 5C:
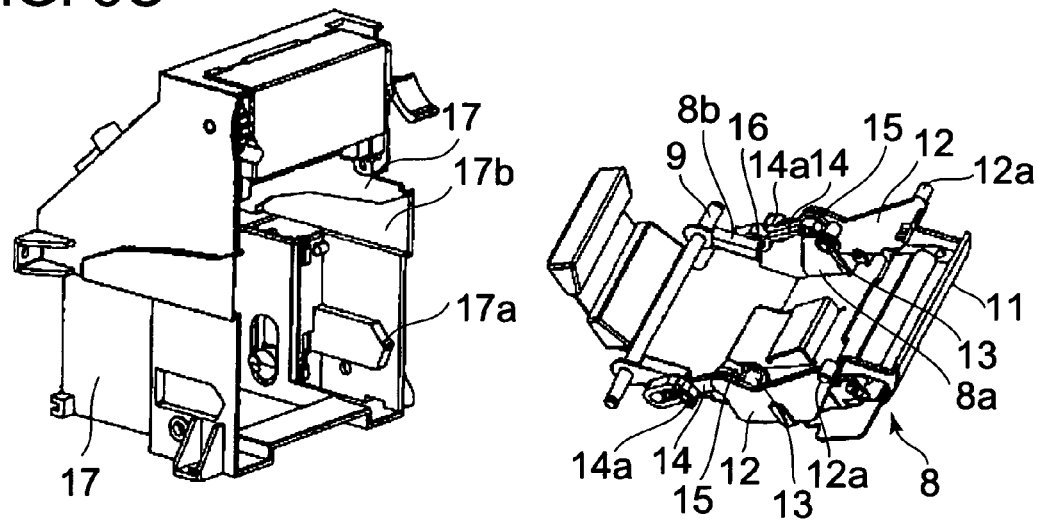
FIG. 5C is an exploded perspective view with the roll body being omitted.
Figure 6A:
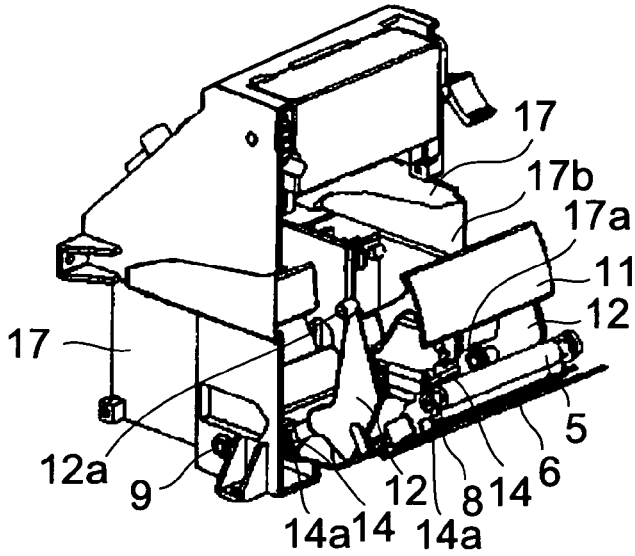
FIG. 6A is a perspective view showing a process of closing the cover of the continuous sheet processing apparatus shown in FIG. 1 with the roll body being omitted.
Figure 6B:
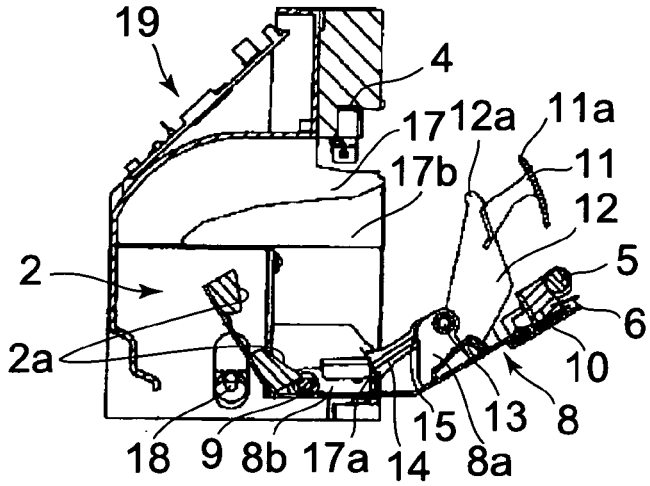
FIG. 6B is a sectional view with the roll body being omitted.
Figure 6C:
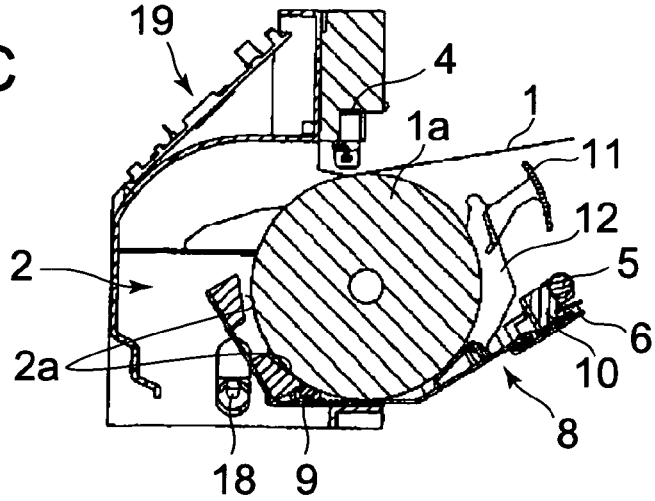
FIG. 6C is a sectional view including the roll body.
Figure 7A:
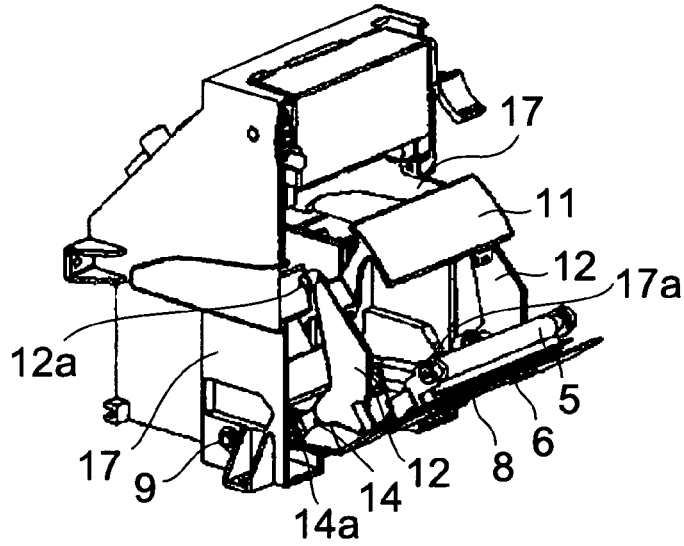
FIG. 7A is a perspective view showing a process of closing the cover of the continuous sheet processing apparatus shown in FIG. 1 with the roll body being omitted.
Figure 7B:
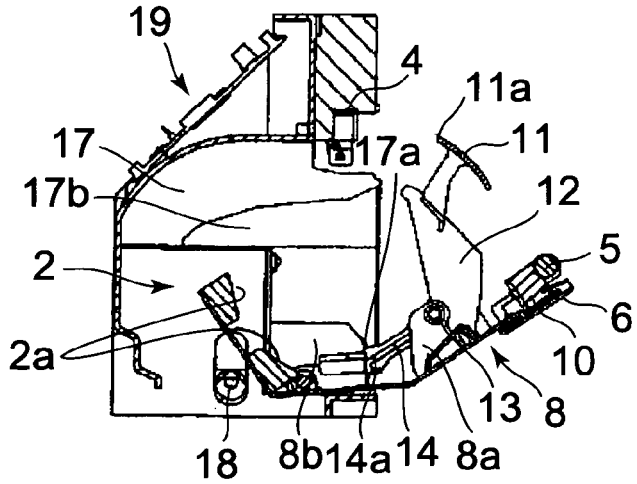
FIG. 7B is a sectional view with the roll body being omitted.
Figure 7C:
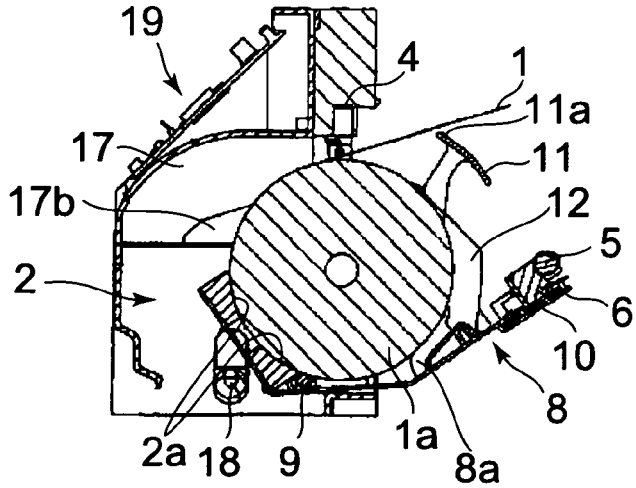
FIG. 7C is a sectional view including the roll body.

Next, the cover 8 starts to be closed. At this time, the protruding portions 14*a* of the link arms 14 abut on the cams 17*a* of the frame 17. A state at a start of the abutment is shown in FIG. 5A. A portion A of FIG. 5A is shown in FIG. 5B) by being enlarged. Further, in order to clarify positions and shapes of the protruding portion 14*a* and the cam 17*a*, FIG. 5C shows an exploded perspective view. When the protruding portions 14*a* of the link arms 14 abut on the cams 17*a* to be pushed, as shown in FIG. 6A-6C, the link arms 14 relatively pivot about the shaft 16 (see, FIG. 4B) with respect to the cover 8. Along with the pivoting of the link arms 14, the arms 12 connected to the link arms 14 through the shaft 15 relatively pivot about the shaft 13 with respect to the cover 8. The pivoting is a movement in which the arms 12 and the guide plate 11 close toward the frame 17 before the cover 8. As described above, in this embodiment, a link mechanism includes the arms 12 and the link arms 14.

Figure 8A:
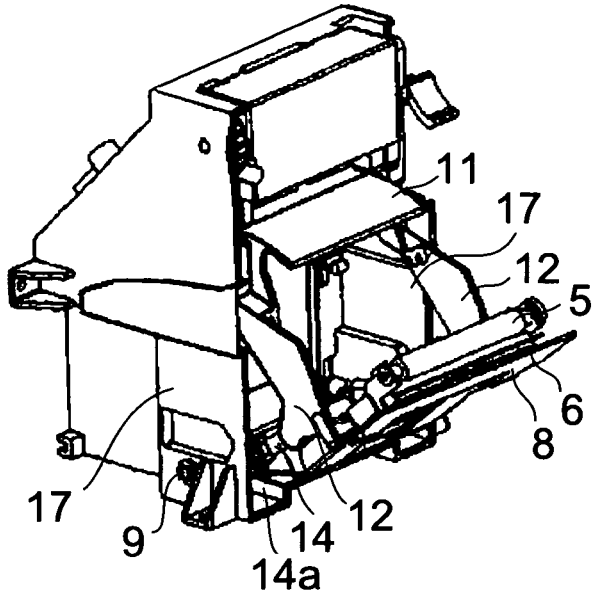
FIG. 8A is a perspective view showing a process of closing the cover of the continuous sheet processing apparatus shown in FIG. 1 with the roll body being omitted.
Figure 8B:
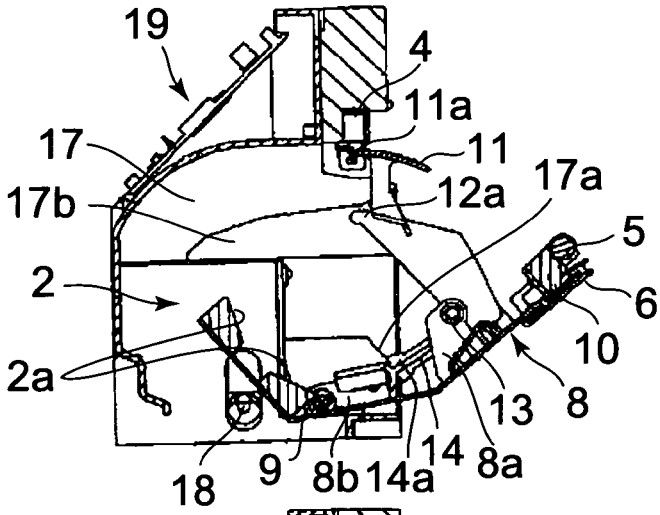
FIG. 8B is a sectional view with the roll body being omitted.
Figure 8C:
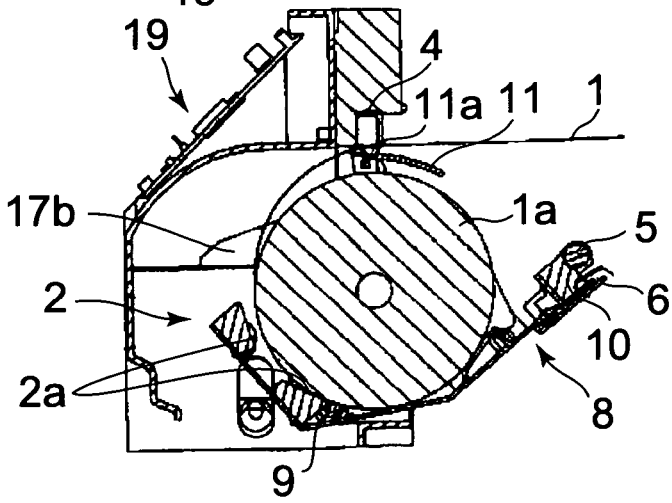
FIG. 8C is a sectional view including the roll body.
Figure 9A:
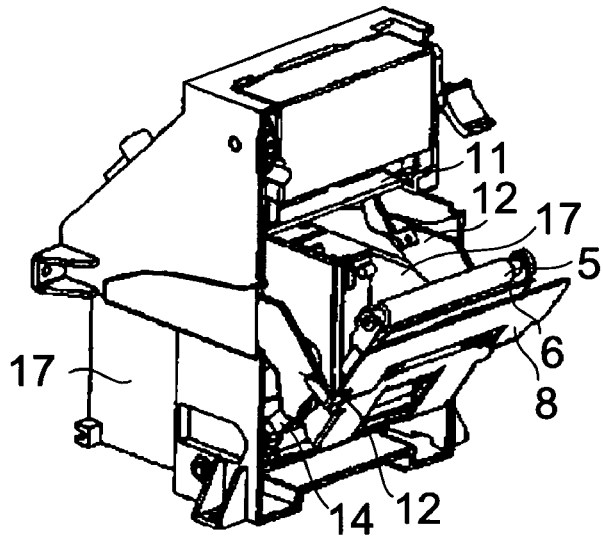
FIG. 9A is a perspective view showing a process of closing the cover of the continuous sheet processing apparatus shown in FIG. 1 with the roll body being omitted.
Figure 9B:
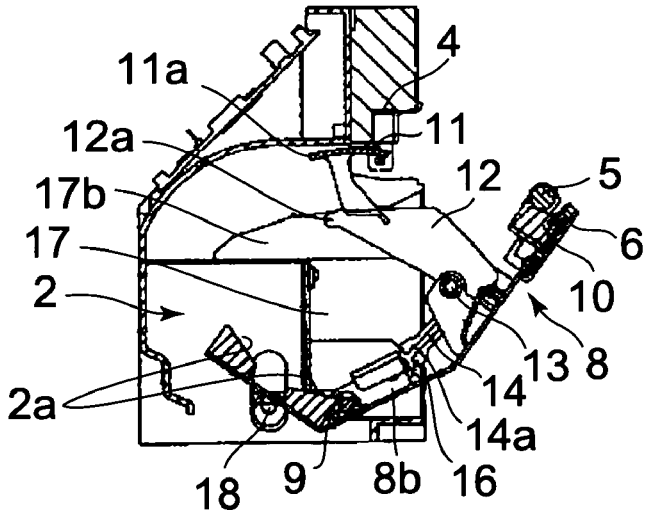
FIG. 9B is a sectional view with the roll body being omitted.
Figure 9C:
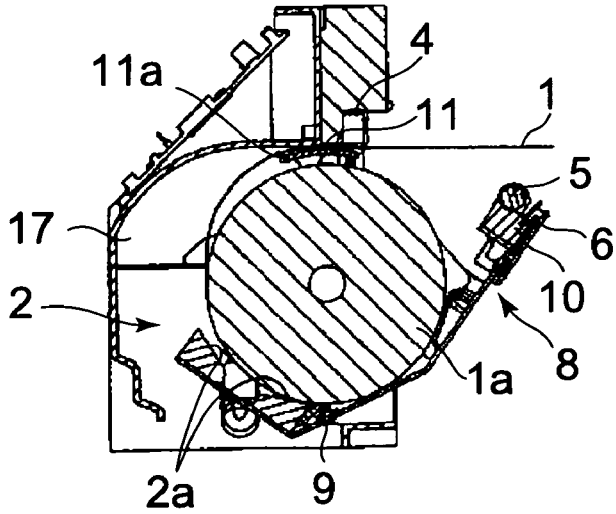
FIG. 9C is a sectional view including the roll body.
Figure 10A:
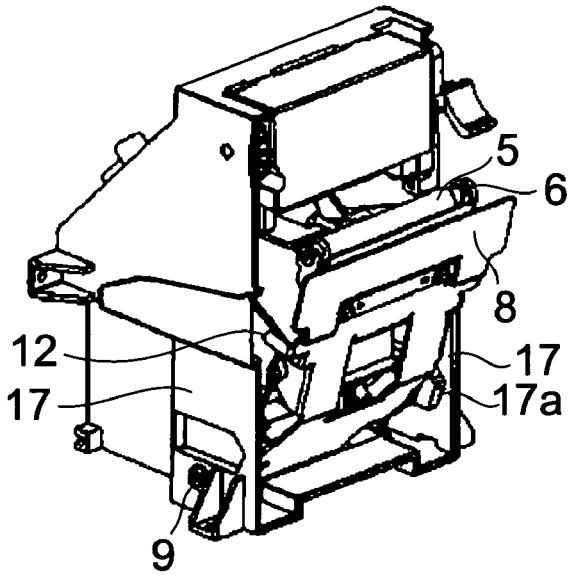
FIG. 10A is a perspective view showing a process of closing the cover of the continuous sheet processing apparatus shown in FIG. 1 with the roll body being omitted.
Figure 10B:
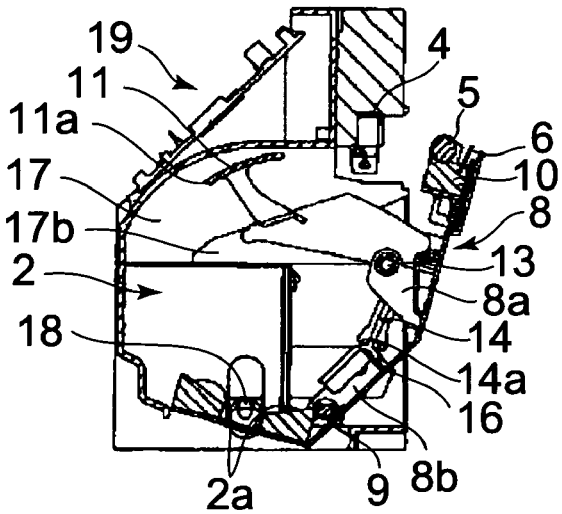
FIG. 10B is a sectional view with the roll body being omitted.
Figure 10C:
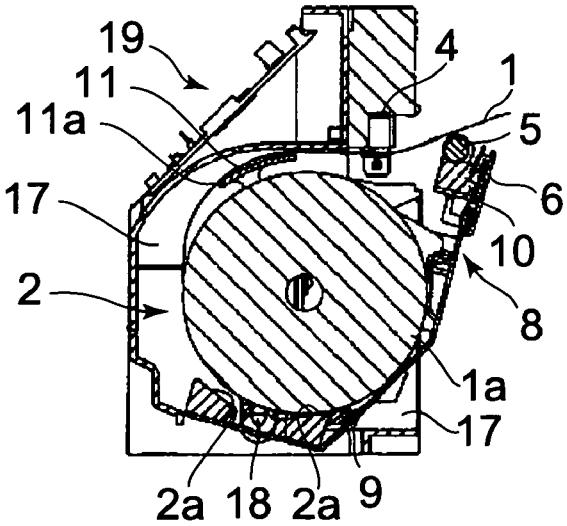
FIG. 10C is a sectional view including the roll body.
Figure 11A:
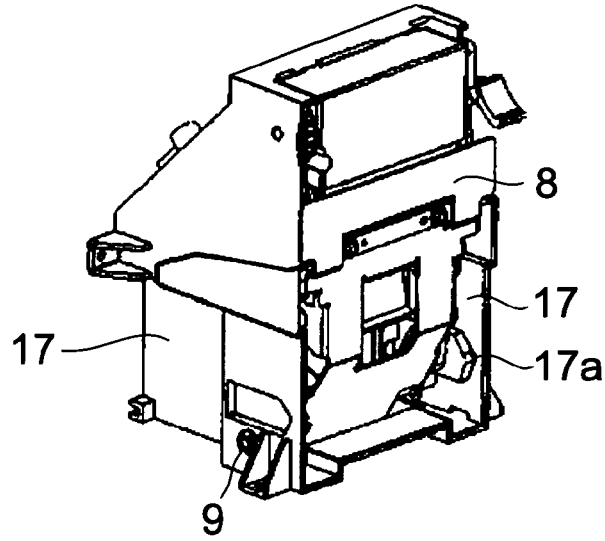
FIG. 11A is a perspective view showing a state where the cover of the continuous sheet processing apparatus shown in FIG. 1 is completely closed with the roll body being omitted.
Figure 11B:
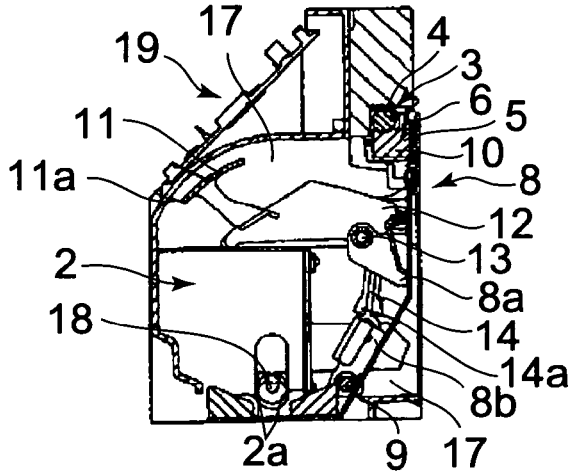
FIG. 11B is a sectional view with the roll body being omitted.
Figure 11C:
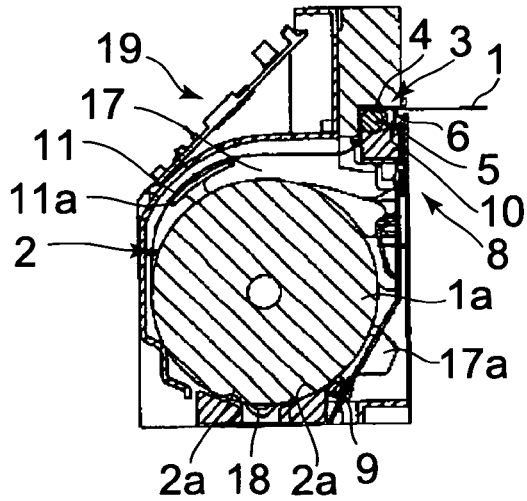
FIG. 11C is a sectional view including the roll body.
Figure 12A:
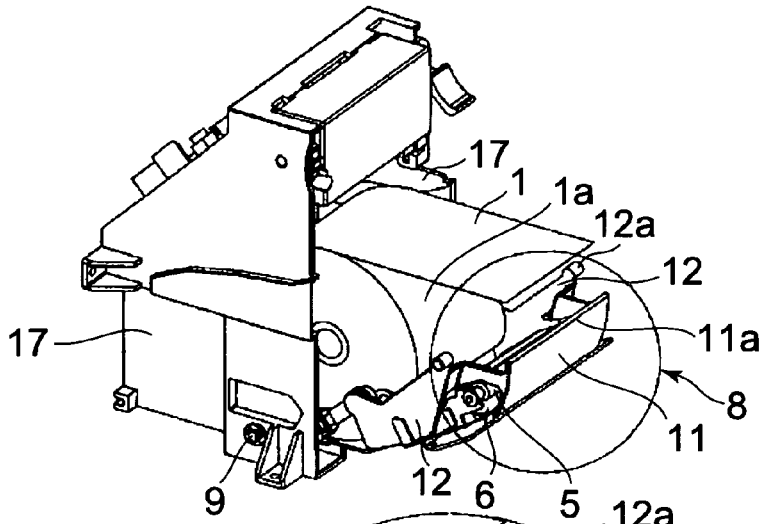
FIG. 12A is a perspective view showing a state where the roll body is inserted into the continuous sheet processing apparatus shown in FIG. 1.
Figure 12B:
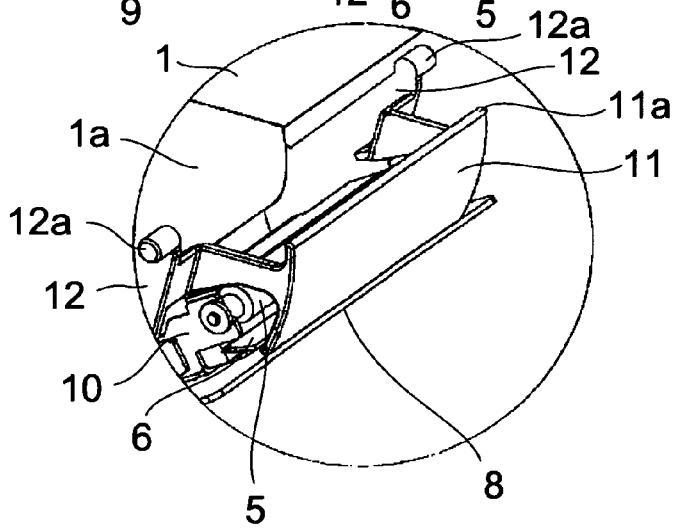
FIG. 12B is an enlarged view of a portion B of FIG. 12A.

In the state where the protruding portion 14*a* of the link arms 14 abut on the cams 17*a*, when the cover 8 itself is closed toward the frame 17, as shown in FIG. 7A-7C to 10A-10C in the stated order, the arms 12 and the guide plate 11 enter the frame 17 toward a deeper side (left side in the figures) thereof before the cover 8. In this case, as shown in FIG. 8C, the guide plate 11 enter a space under the continuous sheet 1 drawn out from the roll body 1*a*, that is, between the roll body 1*a* and the continuous sheet 1 drawn out from the roll body. Further, as shown in FIGS. 8A-8C, the protruding portions 12*a* of the arms enter inside the guide grooves 17*b* of the frame 17. Each of the guide grooves 17*b* is wide on an open side (right side in the figures), thereby allowing the protruding portion 12*a* of the arm 12 to easily enter the guide groove 17*b*. Further, each of the guide grooves 17*b* becomes narrower toward a deeper side (left side in the figures), so a movement path of each of the protruding portions 12*a* is gradually restricted, thereby allowing each of the arms 12 to be correctly guided to a predetermined portion at last. As shown in FIGS. 9A-9C, after the guide plate 11 reaches a position above the central axis of the roll body 1*a*, the guide plate 11 is further moved, and as shown in FIG. 10A-10C, reaches a side (opposite side of the processing portion 3) deeper than the central axis of the roll body 1*a*. At last, as shown in FIGS. 11A-11C, the cover 8 is completely closed.

Note that, in an operation in which the cover 8 is opened in a state where the cover 8 is closed, an operation completely opposite to that described above is performed. That is, the operation is performed in the state shown in FIGS. 11A-11C, the state shown in FIGS. 10A-10C, the state shown in FIGS. 9A-9C, the state shown in FIGS. 8A-8C, the state shown in FIGS. 7A-7C, the state shown in FIGS. 6A-6C, and the state shown in FIGS. 4A-4C in the stated order. In this case, when the cover 8 starts to open, the protruding portions 14*a* of the link arm 14 abut on the cams 17*a*, thereby restricting the movement of the protruding portions 14*a*. Accordingly, the guide plate 11 and the arms 12 open after the movement of the cover 8.

In this embodiment, as shown in FIGS. 1 to 3A-3B and 11A-11C, when the cover 8 is in the closed state, the position P1 of the end portion of the engagement portion 11*a* of the guide plate 11 is on the opposite side of the processing portion 3 (left side in the figures) with respect to the position P3 (the same as center of roll body accommodating portion 2) directly above the central axis of the roll body 1*a*. If the guide plate 11 is fixed to the above-mentioned position, in a case where the cover 8 is opened to insert the roll body 1*a* into the roll body accommodating portion 2, it is highly difficult to set the end portion of the continuous sheet 1 drawn out from the roll body 1*a* such that the end portion passes above the guide plate 11 to be guided to the processing portion 3. That is, an operation, in which the end portion of the continuous sheet 1 drawn out from the roll body 1*a* is allowed to pass through a confined space between the roll body 1*a* and an upper wall of the frame 17 within an extremely small operation space as being understood with reference to FIG. 1C, requires highly intricate work, thereby being extremely difficult.

If the structure allows the cover 8 to be opened to nearly 180 degrees, before the roll body 1*a* is inserted into the roll body accommodating portion 2, in a state where a relatively large operation space is ensured, it is possible to perform the operation of allowing the end portion of the continuous sheet 1 to pass through a space above the guide plate 11. Therefore, it is probable that operability increases. However, with the structure according to this embodiment, in which the processing portion 3 is positioned above the roll body accommodating portion 2 and the cover 8 pivots about the shaft 9 positioned on a lower portion of the frame 17 to be opened and closed, the cover cannot be opened to 90 degrees or more in a state where the apparatus of the present invention is kept placed on a plane. Accordingly, there is a need of temporarily tilting the apparatus to open the cover 8. Thus, the apparatus becomes a product which is extremely difficult to use practically, thereby being unpreferable.

When considerations are made for those cases, the applicant of the present invention conceives that it is preferable that, in the state where the cover 8 is opened, the guide plate 11 be not in the position on the opposite side (left side in the figure) of the processing portion 3 with respect to the P3 directly above the central axis of the roll body 1*a* as shown in FIGS. 1 to 3A-3B and 11A-11C, and the guide plate 11 be provided outside the frame 17 in the same manner as with the cover 8. In the present invention, with the structure with which the guide plate 11 is made movable as the operation independent of the cover 8 or as the combined operation of the opening and closing operation of the cover 8 and the relative movement with respect to the cover 8, there is first realized the structure in which, in the state where the roll body 1*a* is inserted into the roll body accommodating portion 2, when the cover 8 is closed, while keeping the end portion of the continuous sheet 1 drawn out from the roll body 1*a* positioned above the guide plate 11, the guide plate 11 can be moved to the position P1 on the opposite side (left side in the figures) of the processing portion 3. In particular, in the above embodiment, with the link mechanism including the arms 12 and the link arms 14, the guide plate 11 can move together with the opening and closing operation of the cover 8 as the combined operation of the opening and closing operation of the cover 8 and the relative movement with respect to the cover 8. As a result, by only performing an operation in which, when the cover 8 is opened, the roll body 1*a* is inserted into the roll body accommodating portion 2 in the state where the end portion of the continuous sheet 1 is drawn out, and the cover 8 is closed, it is possible to arrange the continuous sheet 1 on the guide plate 11 and to move the guide plate to the predetermined position P1. There is no need for the user to allow the continuous sheet 1 to pass through the confined space between the guide plate 11 and the upper wall of the frame 17. Further, there is also no need to directly move the guide plate 11 itself. It is only necessary to perform the operation of inserting the roll body 1*a* and closing the cover 8, so the operability is extremely high. As is apparent from FIGS. 4A-4C, those operations can sufficiently be performed at an opening angle of the cover 8 of less than 90 degrees. Accordingly, the operations can be performed while keeping the apparatus placed on a plane, thereby making it possible to realize a practically easy-to-use structure thereof.

Note that, as an additional effect of this embodiment, it is exemplified that, as shown in FIGS. 4A-4C and 12A-12B, in the state where the cover 8 is opened, the stationary blade 6 of the cutter portion is covered with the guide plate 11, thereby not being exposed to the outside, so there is no risk that the user touches the stationary blade 6 by mistake.

Another Embodiment

Figure 13:
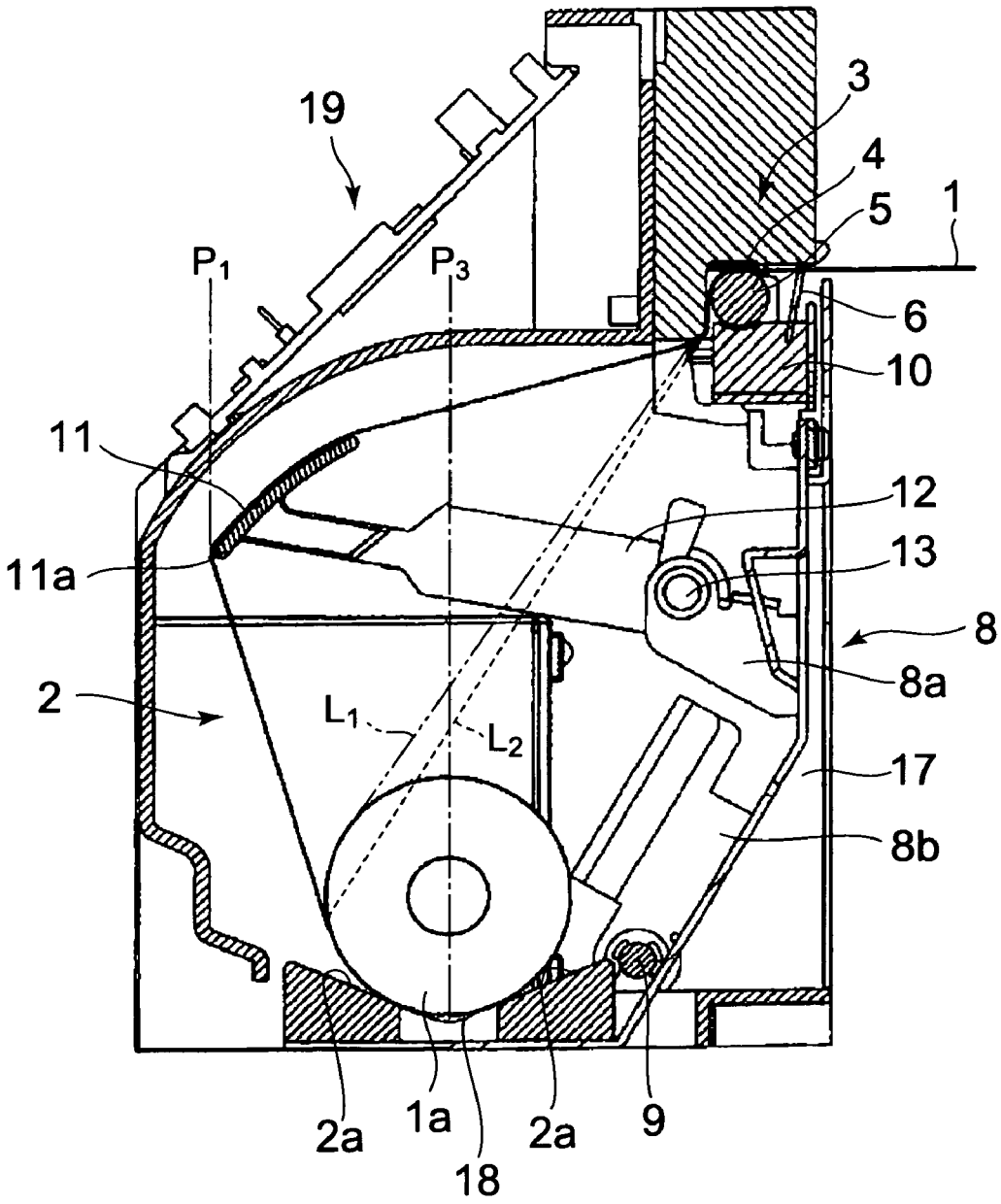
FIG. 13 is a sectional view of a continuous sheet processing apparatus according to a second embodiment of the present invention.
Figure 14:
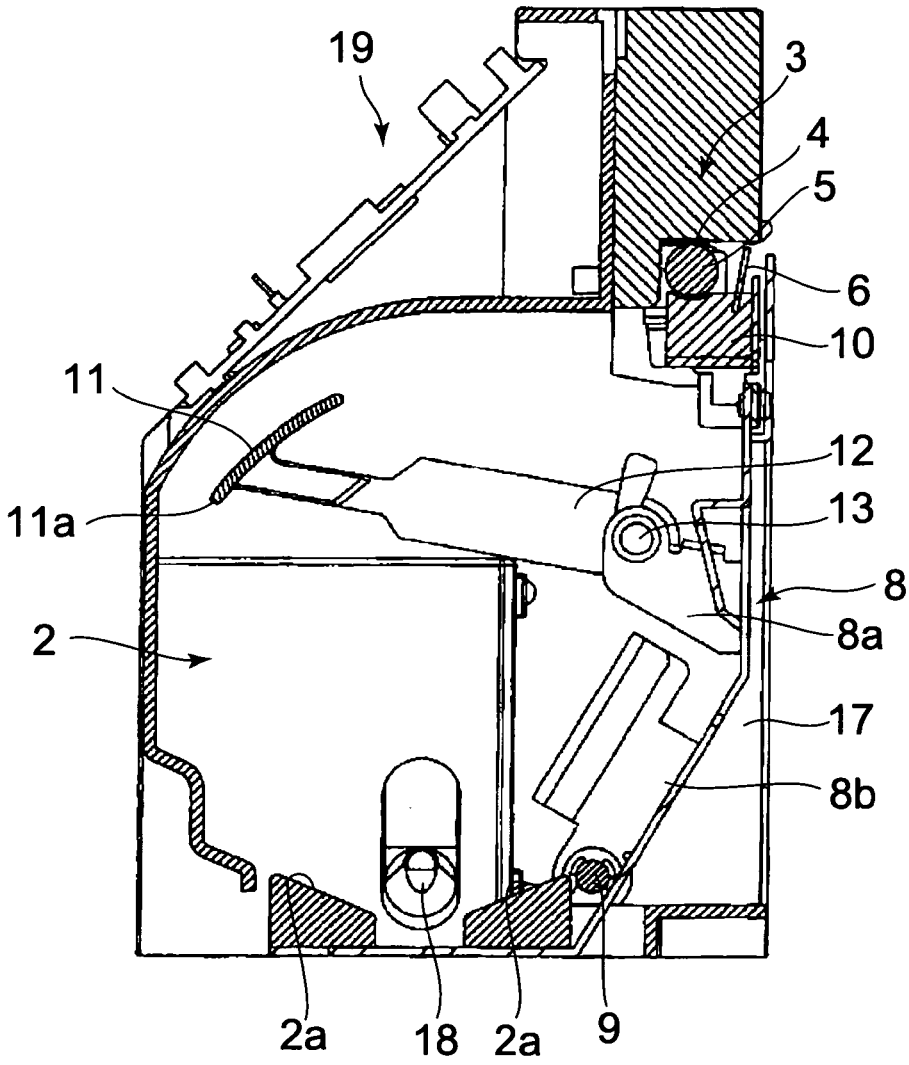
FIG. 14 is a sectional view of the continuous sheet processing apparatus shown in FIG. 13 in a state where a roll body is not set therein.

Next, with reference to FIGS. 13 to 18A-18C, another embodiment of the present invention will be described. FIGS. 13 and 14 each show an internal structure of a continuous sheet processing apparatus according to a second embodiment of the present invention. FIG. 13 shows a state where the roll body 1*a*, in which the continuous sheet 1 is wound, is accommodated. FIG. 14 shows a state where the roll body 1*a* is not accommodated.

The continuous sheet processing apparatus according to this embodiment does not include the link arms 14, the shafts 15 and 16 for connecting the link arms 14, the cams 17*a*, and the guide grooves 17*b*. Further, the springs (not shown) biases the arms 12 toward the frame 17 side. That is, a direction of a bias force applied to the arms 12 by the springs is substantially opposite to that of the first embodiment described above. Other constructions are the same as those of the first embodiment shown in FIGS. 1 and 2, so descriptions thereof will be omitted.

In this embodiment as well, as shown in FIG. 13, the position P1 of the engagement portion 11*a* of the guide plate 11 is on the opposite side (left side in the figure) of the processing portion 3 with respect to the position P3 directly above the central axis of the roll body 1*a*. By the guide plate 11, there is structured the transport path such that the continuous sheet 1 is once guided to the opposite side (left side in FIG. 13) of the processing portion 3 with respect to the straight lines L1 and L2 each connecting the drawing out portion of the roll body 1*a* and the processing portion 3, and is guided to the processing portion 3 thereafter.

In this embodiment, the guide plate 11 and the arms 12 do not move together with the opening and closing operation of the cover 8 and are moved manually. Here, a description will be made of an operation in which the cover 8 is opened to set the roll body 1*a* in the state where the cover 8 is closed as shown in FIGS. 13 to 15.

Figure 15:
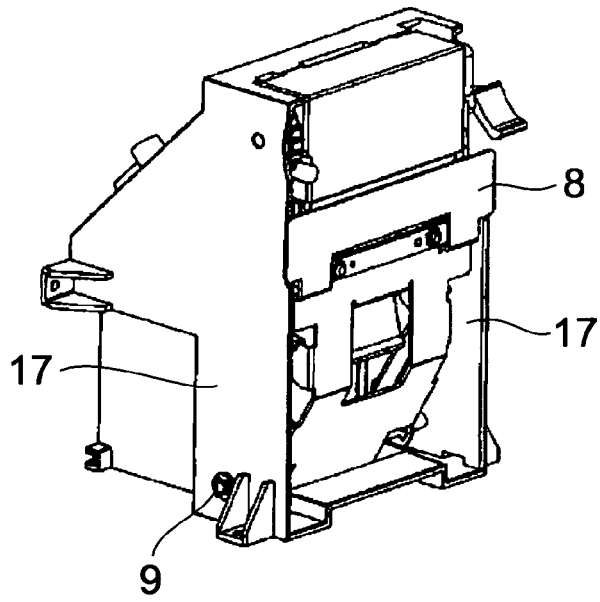
FIG. 15 is a perspective view showing a state where a cover of the continuous sheet processing apparatus shown in FIG. 13 is in a closed state.
Figure 16:
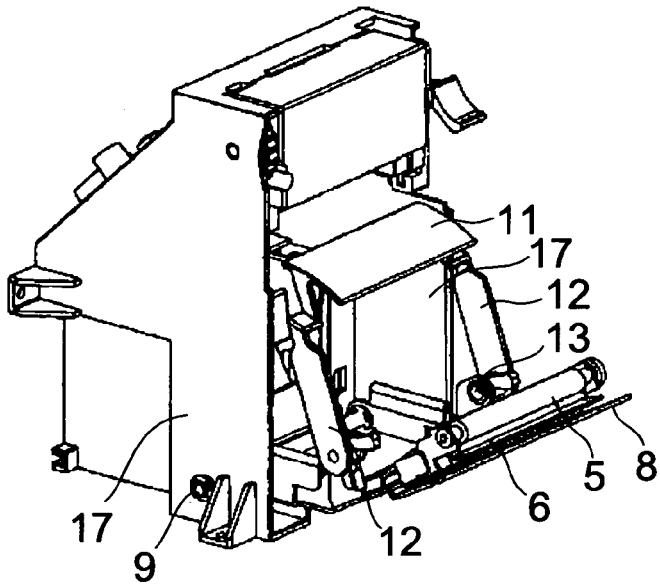
FIG. 16 is a perspective view showing a state where the cover of the continuous sheet processing apparatus shown in FIG. 13 is in an open state.
Figure 17A:
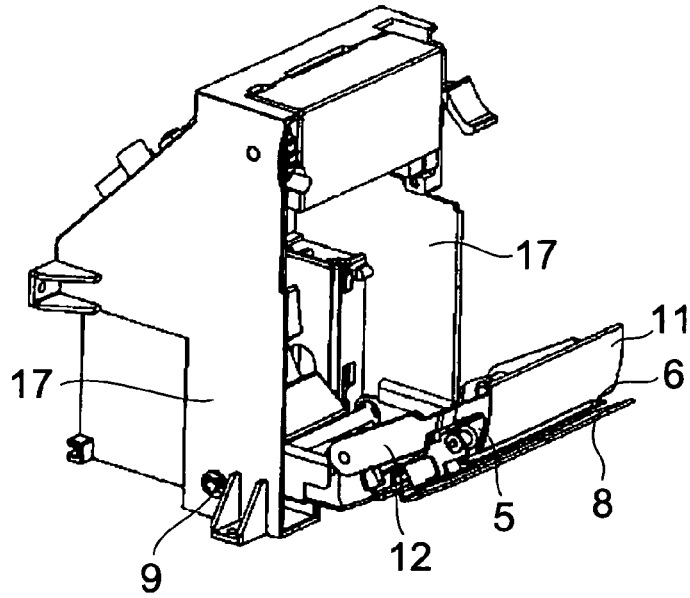
FIG. 17A is a perspective view showing the continuous sheet processing apparatus shown in FIG. 13 in a state where the roll body can be inserted.
Figure 17B:
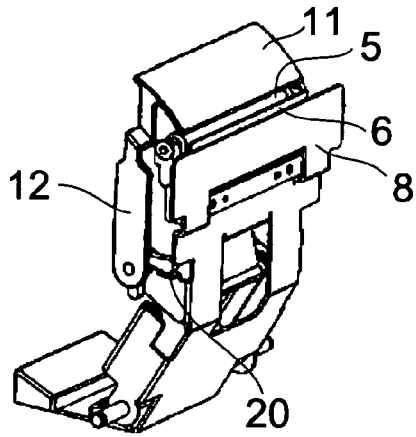
FIG. 17B is a perspective view of the cover shown in FIG. 17A and various members mounted to the cover viewed from a different direction.

First, by opening the cover 8 in the state shown in FIG. 15, as shown in FIG. 16, the guide plate 11 and the arms 12 are biased by the springs (not shown) to remain in the deeper side (left side in the figures) of the frame. In this state, the guide plate 11 acts as an obstacle, so the insertion and taking out of the roll body 1*a* cannot be performed. Accordingly, as shown in FIG. 17A, the user manually pulls out the guide plate 11 and the arms 12 to the outside of the frame 17 against the spring force. Note that FIG. 17B shows, at an angle different from that of FIG. 17A, a state where the guide plate 11 and the arms 12 are manually pulled out in the above-mentioned manner so as to approach the cover 8.

Figure 18A:
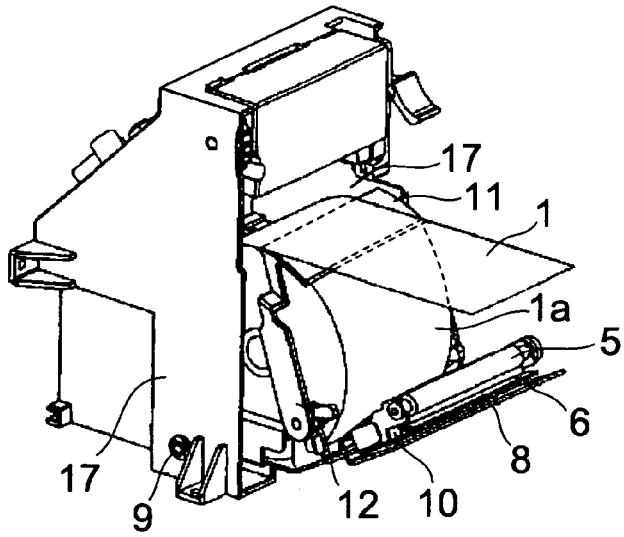
FIG. 18A is a perspective view of the continuous sheet processing apparatus shown in FIG. 13 in a state after the roll body is inserted.
Figure 18B:
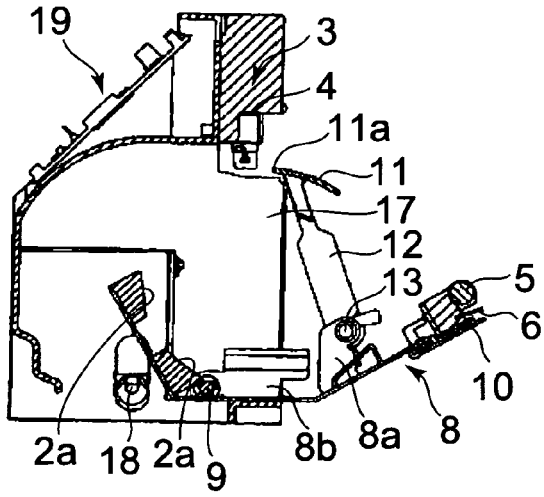
FIG. 18B is a sectional view with the roll body being omitted.
Figure 18C:
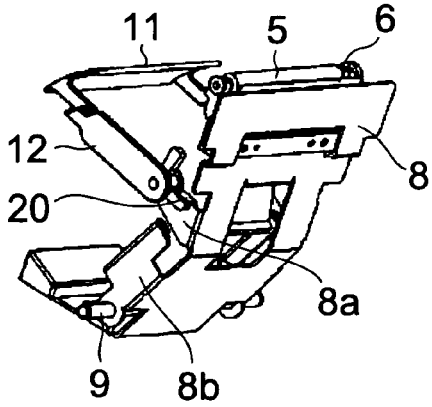
FIG. 18C is a perspective view of the cover shown in FIG. 18A and the various members mounted to the cover viewed from a different direction.
Figure 19:
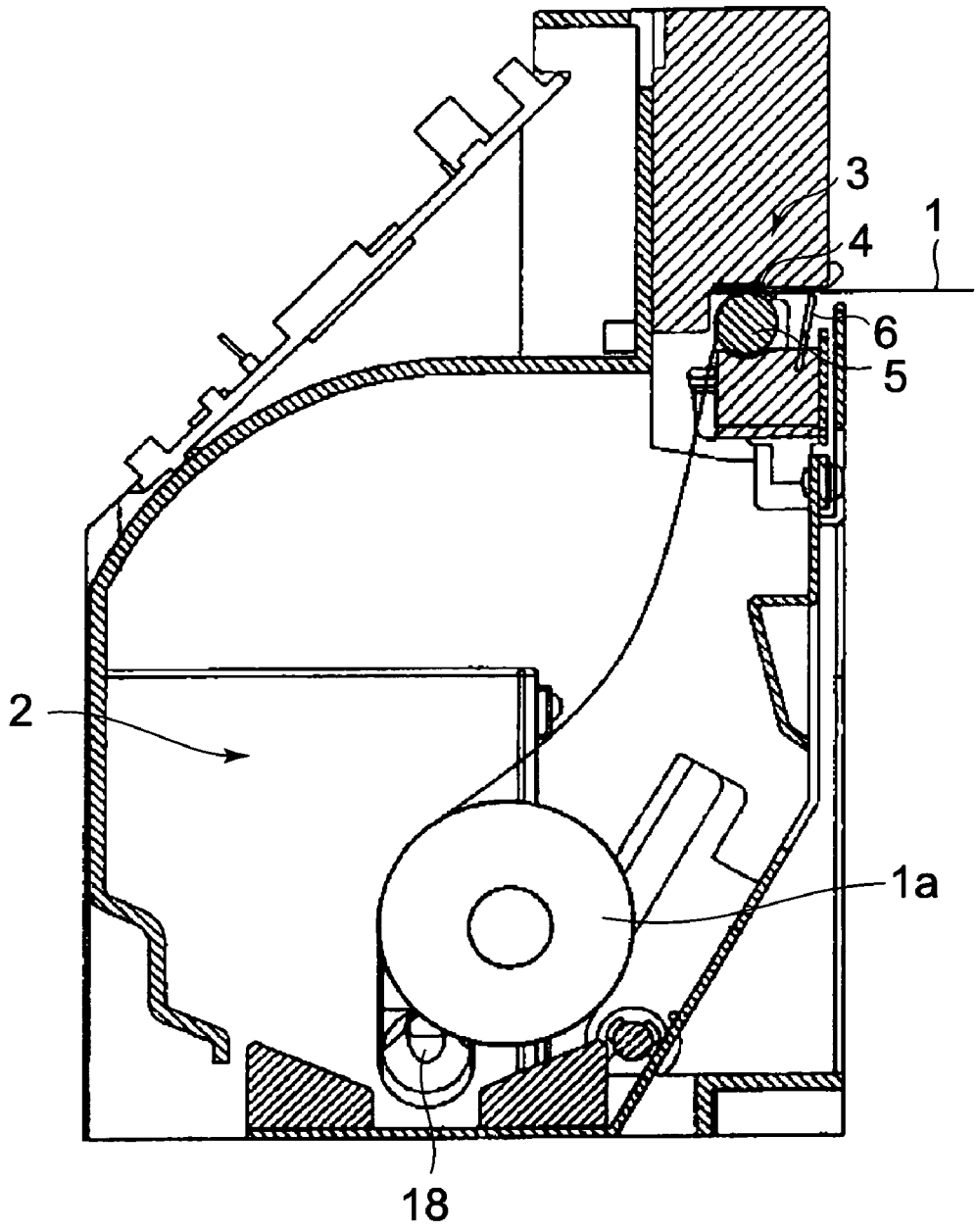
FIG. 19 PRIOR ART
FIG. 19 is a sectional view of a related art continuous sheet processing apparatus.

In this state, after the roll body 1*a* is inserted into the roll body accommodating portion 2, when a hand is moved off from the guide plate 11 and the arms 12, by the bias force of the springs (not shown), the guide plate 11 and the arms 12 are moved to the deeper side (left side of the figures) of the frame. Note that a relative moving angle of each of the arms 12 with respect to the cover 8 is restricted by a stopper 20. Accordingly, as shown in FIGS. 18A-18B, the guide plate 11 stops before entering inside the frame 17. Note that FIG. 18A is a perspective view, FIG. 18B is a sectional view in which the roll body 1*a* is omitted, and FIG. 18C shows a state where the guide plate 11 has moved to the frame 17 side by being biased by the springs (not shown) at an angle different from that of FIG. 18A.

At last, when the cover 8 is closed, the guide plate 11 and the arms 12 are moved integrally with each other to enter inside the frame 17 to reach the deeper side therein, thereby realizing the state as shown in each of FIGS. 13 and 14. Note that the restriction of the relative moving angle of each of the arms 12 with respect to the cover 8 by the stopper 20 is set such that the engagement portion 11*a* of the guide plate 11 is stopped at the desired position. P1 in the state where the cover 8 is completely closed as shown in FIGS. 13 and 14.

In this embodiment as well, the same operational effect as that of the first embodiment described above is obtained. Note that the guide plate 11 and the arms 12 have to be manually moved, so the operation becomes a little complicated, but at the same time, the need of the link arms 14 and the cams 17*a* is eliminated. As a result, it is possible to simplify the structure.

In the two embodiments described above, the guide plate 14 is attached to the cover 8 through the arms 12. However, there may be employed a structure in which the guide plate 14 is pivotally attached to the frame 17 through the arms 12 or another member. In this case, it is possible to more easily realize the structure in which the guide plate 11 and the arms 12 are moved manually in the same manner as that of the second embodiment of the present invention than the structure in which the guide plate 11 and the arms 12 automatically move together with the opening and closing of the cover 8 in the same manner as that of the first embodiment of the present invention. In both the cases, when the guide plate 14 is movable between the predetermined position P1 and the outside of the frame 17 as the operation independent of the opening and closing of the cover 8 or as the combined operation of the opening and closing operation of the cover 8 and the relative movement with respect to the cover 8, the same effect as that described above can be achieved.

What is claimed is:

1. A continuous sheet processing apparatus comprising:

a frame;

a roll body accommodating portion disposed inside of the frame for accommodating a roll body formed of a wound continuous sheet;

a cover which can be opened and closed with respect to the frame to allow insertion of the wound continuous sheet into the roll body accommodating portion in a state in which the cover is in the open state;

a processing portion arranged in a position above the roll body accommodating portion and horizontally shifted from a position directly above a central axis of the roll body accommodated in the roll body accommodating portion, the processing portion having a processing head for performing a processing operation with respect to the continuous sheet drawn out from the roll body accommodating portion in a state in which the cover is in the closed state and having a platen roller arranged opposite to the processing head for transporting the continuous sheet in a state in which the cover is in the closed state;

a guide member positioned between the roll body accommodating portion and the processing portion for guiding the continuous sheet drawn out from the roll body, the guide member having an engagement portion that engages with the continuous sheet drawn out from the roll body accommodating portion; and an arm connected to the guide member and mounted to the frame for undergoing movement between an inside of the frame and an outside of the frame during an operation independent of an opening and closing operation of the cover or as a combined operation of the opening and closing operation of the cover and a relative movement with respect to the cover, so that in a state in which the arm is positioned inside of the frame, at least a part of the engagement portion of the guide member is arranged above the roll body accommodated in the roll body accommodating portion and in a position on an opposite side of the processing portion with respect to the central axis of the roll body.

2. A continuous sheet processing apparatus according to claim 1; wherein the arm is pivotally connected to the cover.

3. A continuous sheet processing apparatus according to claim 2; further comprising a link arm pivotally connected to each of the arm and the cover, the link arm and the arm forming a link mechanism for moving the guide member with opening and closing operations of the cover.

4. A continuous sheet processing apparatus according to claim 3; wherein a part of the link arm of the link mechanism abuts on a cam provided to the frame to thereby allow the link arm to relatively pivot with respect to the cover; wherein the arm is connected to the link arm so that the arm is allowed to relatively pivot with respect to the cover together with pivoting of the link arm relative to the cover.

5. A continuous sheet processing apparatus according to claim 1; wherein the arm is connected to the guide member and is mounted to the frame so that the arm moves before the cover during a closing operation of the cover and moves by following the cover during an opening operation of the cover.

6. A continuous sheet processing apparatus according to claim 1; wherein the arm is configured for being moved manually.

7. A continuous sheet processing apparatus according to claim 1; wherein the processing portion comprises a printing portion for performing printing on the continuous sheet drawn out from the roll body accommodating portion.

8. A continuous sheet processing apparatus according to claim 1; wherein the processing portion comprises a thermal activation portion for heating and thermally activating the continuous sheet drawn out from the roll body accommodating portion.

9. A method of setting a roll body in a continuous sheet processing apparatus, comprising the steps of:

providing a continuous sheet processing apparatus comprised of a frame; a roll body accommodating portion disposed inside of the frame for accommodating a roll body formed of a wound continuous sheet; a cover which can be opened and closed with respect to the frame to allow insertion of the wound continuous sheet into the roll body accommodating portion in a state in which the cover is in the open state; a processing portion arranged in a position above the roll body accommodating portion and horizontally shifted from a position directly above a central axis of the roll body accommodated in the roll body accommodating portion, the processing portion having a processing head for performing a processing operation with respect to the continuous sheet drawn out from the roll body accommodating portion in a state in which the cover is in the closed state and having a platen roller arranged opposite to the processing head for transporting the continuous sheet in a state in which the cover is in the closed state; a guide member positioned between the roll body accommodating portion and the processing portion for guiding the continuous sheet drawn out from the roll body, the guide member having an engagement portion that engages with the continuous sheet drawn out from the roll body accommodating portion; and an arm connected to the guide member and mounted to the frame for undergoing movement between an inside of the frame and an outside of the frame during an operation independent of an opening and closing operation of the cover or as a combined operation of the opening and closing operation of the cover and a relative movement with respect to the cover;

with the cover in an open state, inserting the roll body into the roll body accommodating portion in a state where an end portion of the continuous sheet is pulled out from the roll body;

after starting an operation of closing the cover with respect to the frame, moving the arm to which the guide member is attached to position the guide member into a space between the roll body and the continuous sheet pulled out from the roll body; and after the cover is closed with respect to the frame, engaging at least a part of the engagement portion of the guide member with the continuous sheet while arranging the part of the engagement portion in a position above the roll body and on an opposite side of the processing portion with respect to the central axis of the roll body.

10. A method of setting a roll body in a continuous sheet processing apparatus according to claim 9; wherein the movement of the arm is performed as an operation independent of the operation of closing the cover or as a combined operation of an opening and closing operation of the cover and a relative movement of the arm with respect to the cover.

11. A method of setting a roll body in a continuous sheet processing apparatus according to claim 9; wherein:

the providing step further comprises providing the continuous sheet processing apparatus that further comprises a link arm pivotally connected to each of the arm and the cover so that the link arm and the arm form a link mechanism for moving the guide member with opening and closing operations of the cover; and after the operation of closing the cover with respect to the frame is started, a part of the link arm is allowed to abut on a cam provided to the frame, thereby relatively pivoting the link arm with respect to the cover to relatively pivot the arm connected to the link arm with respect to the cover together with pivoting of the link arm.

12. A method of setting a roll body in a continuous sheet processing apparatus according to claim 9; wherein the step of moving the arm comprises moving the arm before the cover during a closing operation of the cover; and further comprising the step of moving the arm by following the cover during an opening operation of the cover.

13. A continuous sheet processing apparatus according to claim 1; wherein the roll body accommodating portion has a pair of inclined surfaces that support an outermost peripheral surface of the roll body.

14. A continuous sheet processing apparatus according to claim 13; wherein the pair of inclined surfaces are configured for coming into line contact with the outermost peripheral surface of the roll body so that a center of the roll body and a center of the roll body accommodating portion are positioned on the same straight line.

15. A continuous sheet processing apparatus comprising:

a frame;

a roll body accommodating portion disposed inside of the frame for accommodating a roll body formed of a wound continuous sheet;

a cover mounted for undergoing pivotal movement between open and closed positions relative to the frame so as to allow the insertion of the wound continuous sheet into the roll body accommodating portion in the open position of the cover;

a processing portion having a processing head for performing a processing operation with respect to the continuous sheet drawn out from the roll body accommodating portion in a state in which the cover is in the closed position, and having a platen roller confronting the processing head for transporting the continuous sheet in a state in which the cover is in the closed position; and a guide member positioned relative to the roll body accommodating portion and the processing portion so as to guide the continuous sheet drawn out from the roll body.

16. A continuous sheet processing apparatus according to claim 15; wherein the guide member has an engagement portion that engages with the continuous sheet drawn out from the roll body accommodating portion.

17. A continuous sheet processing apparatus according to claim 16; further comprising an arm connected to the guide member and mounted to the frame for undergoing movement between an inside of the frame and an outside of the frame during an operation independent of an opening and closing operation of the cover or as a combined operation of the opening and closing operation of the cover; wherein in a state in which the arm is positioned inside of the frame, at least a part of the engagement portion of the guide member is arranged above the roll body accommodated in the roll body accommodating portion and in a position on an opposite side of the processing portion with respect to a central axis of the roll body.

18. A continuous sheet processing apparatus according to claim 15; further comprising a link mechanism for moving the guide member within a preselected range of movement independently of the cover, the link mechanism comprising a pair of arms mounted to respective first projection portions of the cover for undergoing pivotal movement, and a pair of link arms mounted between the respective arms and second projection portions of the cover for undergoing pivotal movement relative to the respective arms.

19. A continuous sheet processing apparatus according to claim 15; wherein the roll body accommodating portion has a pair of inclined surfaces that support an outermost peripheral surface of the roll body.

20. A continuous sheet processing apparatus according to claim 15; wherein the pair of inclined surfaces are configured for coming into line contact with the outermost peripheral surface of the roll body so that a center of the roll body and a center of the roll body accommodating portion are positioned on the same straight line.

* * * * *